US009482048B2

(12) United States Patent
Anderson et al.

(10) Patent No.: US 9,482,048 B2
(45) Date of Patent: Nov. 1, 2016

(54) CONTROL FOR MOVABLE RAIL

(71) Applicant: Hunter Douglas Inc., Pearl River, NY (US)

(72) Inventors: Richard Anderson, Whitesville, KY (US); Eugene W. Thompson, Maceo, KY (US); Steven R. Haarer, Whitesville, KY (US)

(73) Assignee: Hunter Douglas, Inc., Pearl River, NY (US)

( * ) Notice: Subject to any disclaimer, the term of this patent is extended or adjusted under 35 U.S.C. 154(b) by 0 days.

(21) Appl. No.: 14/508,030

(22) Filed: Oct. 7, 2014

(65) Prior Publication Data

US 2015/0075729 A1 Mar. 19, 2015

Related U.S. Application Data

(63) Continuation-in-part of application No. 13/404,874, filed on Feb. 24, 2012, now Pat. No. 8,887,786.

(60) Provisional application No. 61/449,877, filed on Mar. 7, 2011.

(51) Int. Cl.

| | |
|---|---|
| ***E06B 9/322*** | (2006.01) |
| ***E06B 9/30*** | (2006.01) |
| ***E06B 9/326*** | (2006.01) |
| ***E06B 9/262*** | (2006.01) |

(52) U.S. Cl.

CPC ..... *E06B 9/322* (2013.01); *E06B 9/262* (2013.01); *E06B 9/30* (2013.01); *E06B 9/326* (2013.01); *E06B 2009/2627* (2013.01); *E06B 2009/3222* (2013.01)

(58) Field of Classification Search

CPC ..... E06B 2009/3222; E06B 2009/3225; E06B 2009/2441; E06B 2009/2625; E06B 2009/2627

USPC ..... 160/167 R, 279, 84.06, 84.03, 84.05, 160/170, 171, 115

See application file for complete search history.

(56) References Cited

U.S. PATENT DOCUMENTS

| | | | | |
|---|---|---|---|---|
| 564,482 | A * | 7/1896 | Burrowes | A24F 1/00 131/207 |
| 2,401,770 | A | 6/1946 | Nardulli | |
| 5,535,806 | A * | 7/1996 | Kold | E06B 9/40 160/273.1 |
| 5,791,390 | A | 8/1998 | Watanabe | |
| 6,024,154 | A | 2/2000 | Wang | |
| 6,536,503 | B1 | 3/2003 | Anderson | |
| 6,644,372 | B2 | 11/2003 | Judkins | |
| 6,644,375 | B2 | 11/2003 | Palmer | |
| 6,854,502 | B2 | 2/2005 | Lai | |
| 6,948,545 | B1 | 9/2005 | Cheng | |
| 7,025,107 | B2 | 4/2006 | Ciuca | |
| 7,093,644 | B2 | 8/2006 | Strand | |
| 7,096,917 | B2 | 8/2006 | Ciuca | |
| 7,117,919 | B2 | 10/2006 | Judkins | |
| 7,168,476 | B2 | 1/2007 | Chen | |
| 7,331,370 | B1 | 2/2008 | Militello | |
| 7,740,045 | B2 | 6/2010 | Anderson | |
| 2002/0088562 | A1 | 7/2002 | Palmer | |
| 2003/0226644 | A1 | 12/2003 | Koot et al. | |
| 2006/0118248 | A1 | 6/2006 | Anderson | |

(Continued)

*Primary Examiner* — David Purol

(74) *Attorney, Agent, or Firm* — Dority & Manning, P.A.

(57) ABSTRACT

A covering for an architectural opening has a horizontal movable rail supported by cords, with a variety of configurations which allow the movable rail to be moved up and down while concealing the cords.

17 Claims, 41 Drawing Sheets

(56) References Cited

U.S. PATENT DOCUMENTS

2006/0196612 A1 9/2006 Strand
2007/0023151 A1 2/2007 Judkins
2007/0084567 A1 4/2007 Chen
2011/0005690 A1 1/2011 Harding

* cited by examiner

CONTROL FOR MOVABLE RAIL

This application is a continuation-in-part of U.S. patent application Ser. No. 13/404,874, filed Feb. 24, 2012, which claims priority from U.S. Provisional Application Ser. No. 61/449,877, filed Mar. 7, 2011, both of which are hereby incorporated herein by reference.

BACKGROUND OF THE INVENTION

The present invention relates to an arrangement for opening and closing coverings for architectural openings such as Venetian blinds, pleated shades, cellular shades, and vertical blinds.

Usually, a transport system for a covering that extends and retracts in the vertical direction has a fixed head rail which both supports the covering and hides the mechanisms used to raise and lower or extend and retract the covering. Such a transport system is described in U.S. Pat. No. 6,536,503, Modular Transport System for Coverings for Architectural Openings, which is hereby incorporated herein by reference. In the typical covering product that retracts at the top and then extends by moving downwardly from the top (top/down), the extension and retraction of the covering is done by lift cords suspended from the head rail and attached to the bottom rail. In a Venetian blind, there also are ladder tapes that support the slats, and the lift cords usually run through holes in the middle of the slats. In these types of coverings, the force required to raise the covering is at a minimum when the covering is fully lowered (fully extended), since the weight of the slats is supported by the ladder tapes, so that only the bottom rail is being raised by the lift cords at the outset. As the covering is raised further, the slats stack up onto the bottom rail, transferring the weight of the covering from the ladder tapes to the lift cords, so progressively greater lifting force is required to raise the covering as it approaches the fully raised (fully retracted) position.

Some window covering products are built to operate in the reverse (bottom-up), where the moving rail, instead of being at the bottom of the window covering bundle, is at the top of the window covering bundle, between the bundle and the head rail, such that the bundle is normally accumulated at the bottom of the window when the covering is retracted and the moving rail is at the top of the window covering, next to the head rail, when the covering is extended. There are also composite products which are able to do both, to go top-down and/or bottom-up. In the top-down/bottom-up (TDBU) arrangements, the window shades or blinds have an intermediate movable rail and a bottom movable rail.

Known cord drives have some drawbacks. For instance, the cords in a cord drive may be hard to reach when the cord is high up (and the blind is in the fully lowered position), or the cord may drag on the floor when the blind is in the fully raised position. The cord drive also may be difficult to use, requiring a large amount of force to be applied by the operator, or requiring complicated changes in direction in order to perform various functions such as locking or unlocking the drive cord. There also may be problems with overwrapping of the cord onto the drive spool, and many of the mechanisms for solving the problem of overwrapping require the cord to be placed onto the drive spool at a single location, which prevents the drive spool from being able to be tapered to provide a mechanical advantage.

It often is desirable to hide the cords so there are no loose cords. However, this can be difficult, especially when there is more than one movable rail, which generally means that there are many cords that have to be hidden.

SUMMARY

Various arrangements are presented for moving a covering from one position to another using lift cords that are hidden and eliminating loose cords. In one embodiment, the user actuates a mechanism on a handle on a movable rail, and then raises or lowers the movable rail to extend or retract the covering. Release of the handle mechanism automatically locks the movable rail in the position it was in when the handle mechanism was released.

In another embodiment, an indexing mechanism, functionally connected to the lift rod of the movable rail, functions to automatically rotate lift stations in the movable rail to wind up or unwind the lift cord as the movable rail is raised or lowered without requiring a motor to rotate the lift rod. (A motor could be used to assist the indexing mechanism, if desired.)

In another embodiment, an upper movable rail rides up and down on the lift cords of a lower movable rail.

In still another embodiment, an upper movable rail is suspended on a first set of lift cords that extend upwardly to fixed points, and a lower movable rail is suspended from the upper movable rail by a second set of lift cords. This embodiment includes an arrangement that prevents the lower movable rail from extending beyond the bottom of the architectural opening when the upper movable rail is fully extended.

DESCRIPTION

FIGS. 1 through 10 illustrate one embodiment of a horizontal covering for an architectural opening (which may hereinafter be referred to as a window covering or blind or shade). This particular embodiment is a cellular shade 10, with a lock mechanism 12 (illustrated in further detail in FIGS. 4 through 9). The user applies an outside force to de-activate the lock mechanism 12 for raising or lowering the shade (retracting and extending the expandable material). When the shade is in the desired position, the user stops applying the outside force, and the lock mechanism automatically locks and holds the shade in place. This same lift arrangement could be used for a Venetian blind.

Figure 2:
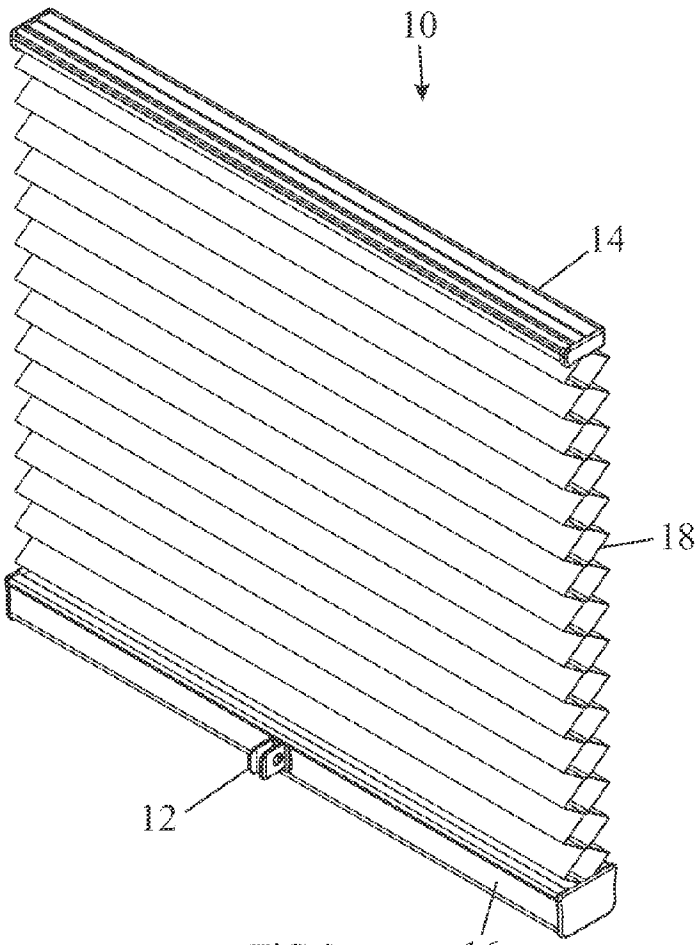
FIG. 2 is a perspective view of the shade of FIG. 1, with the lock in the unlocked position.
Figure 1:
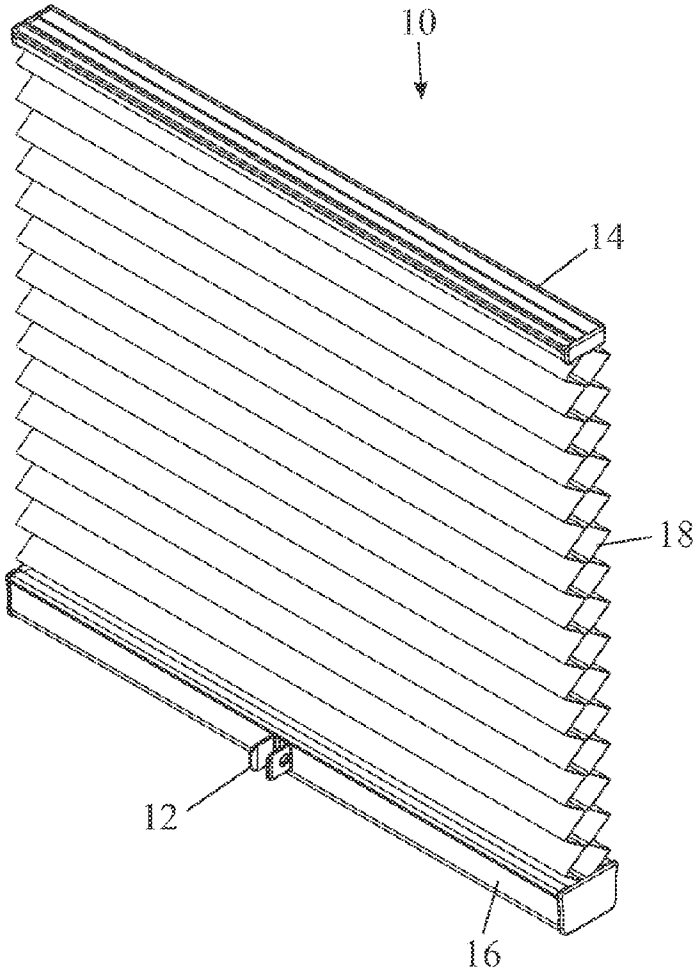
FIG. 1 is a perspective view of a cellular shade incorporating a lock mechanism shown in the locked position.
Figure 3:
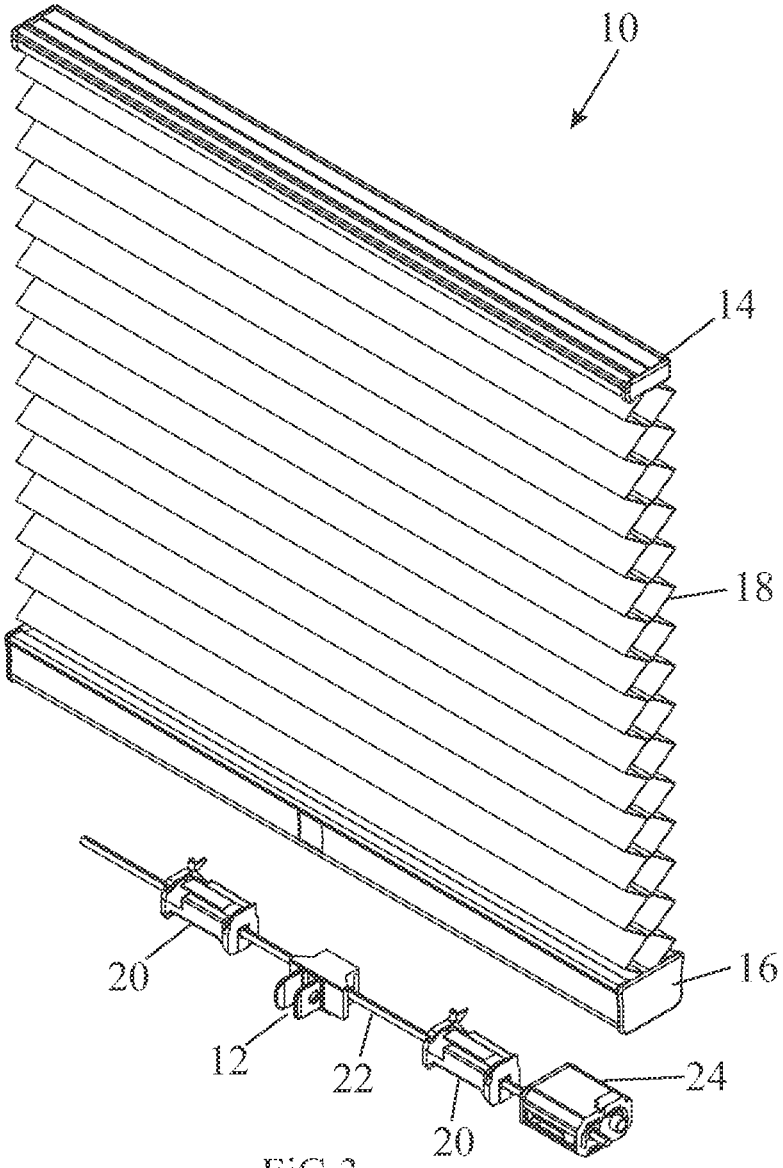
FIG. 3 is a partially exploded perspective view of the shade of FIG. 1, showing the components that are housed in the movable rail.

The shade 10 of FIGS. 1-3 includes a head rail 14, a bottom rail 16, and a cellular shade structure 18 suspended from the head rail 14 and attached to both the head rail 14 and the bottom rail 16. Lift cords (not shown) are attached to the head rail 14, extend through openings in the cellular shade 18, and terminate at lift stations 20 housed in the bottom rail 16. A lift rod 22 extends through the lift stations 20 and through the locking mechanism 12. The lift spools on the lift stations 20 rotate with the lift rod 22, and the lift cords wrap onto or unwrap from the lift stations 20 to raise or lower the bottom rail 16 and thus raise or lower the shade 10. A spring motor 24 is functionally attached to the lift rod 22 to provide an assisting force when raising the shade.

These lift stations 20 and spring motor 24, and their operating principles are disclosed in U.S. Pat. No. 6,536,503 "Modular Transport System for Coverings for Architectural Openings", issued Mar. 25, 2003, which is hereby incorporated herein by reference. Very briefly, the lift rod 22 is rotationally connected to an output spool on the spring motor 24. A flat spring (not shown) in the spring motor 24 has a first end connected to the output spool (having a first axis of rotation) of the spring motor 24. The second end of the flat spring in the spring motor 24 is either connected to a storage spool (not shown) having a second axis of rotation, or is coiled about an imaginary axis defining this second axis of rotation. The flat spring is biased to return to its "normal" state, wound around the second axis of rotation, and typically this corresponds to when the shade 10 is in the fully raised position (retracted). As the shade 10 is pulled down (extended) the flat spring unwinds from the second axis of rotation and winds onto the output spool, increasing the potential energy stored in the spring. When the shade 10 is raised (retracted) the spring winds back onto the storage spool, using some of the potential energy to assist the user in raising the shade 10 by rotating the output spool and thus the lift rod 22 connected to the output spool of the spring motor 24.

In this embodiment, the main purpose of the spring motor is to wind up the lift cord as the shade 10 is raised. To operate the shade, the user applies an external force to unlock the locking mechanism 12 and manually positions the rail 16. He then releases the external force, and the locking mechanism 12 automatically locks to hold the rail 16 in the desired position regardless of the relationship of the spring power to the weight of the shade. The spring may be underpowered (having enough power to wind up the lift cord but not enough power to raise the shade) or it may be overpowered (having enough power to wind up the lift cord and additional power to raise the shade).

In one embodiment for a Venetian-type blind, this spring motor 24 includes a spring with a negative power curve such that, when the force required to raise the blind is at a minimum (when the Venetian blind is fully extended), the spring provides the least assist, and as a progressively greater lifting force is required to raise the slats of the blind (as the Venetian blind approaches the fully retracted position) the spring provides more of an assist. This spring with a negative power curve is disclosed in U.S. Pat. No. 7,740,045 "Spring Motor and Drag Brake for Drive for Coverings for Architectural Openings", issued Jun. 22, 2010, which is hereby incorporated herein by reference.

Each lift station 20 includes a lift spool which rotates with the lift rod 22. The lift stations 20, lift rod 22, and spring motor 24 are mounted in the bottom rail 16. When the lift rod 22 rotates, so do the lift spools of the lift stations 20, and vice versa. One end of each lift cord is connected to a respective lift spool of a respective lift station 20, and the other end of each lift cord is connected to the top rail 14, such that, when the lift spools rotate in one direction, the lift cords wrap onto the lift spools and the shade 10 is raised (retracted), and when the lift spools rotate in the opposite direction, the lift cords unwrap from the lift spools and the shade 10 is lowered (extended).

Lock Mechanism

Figure 5:
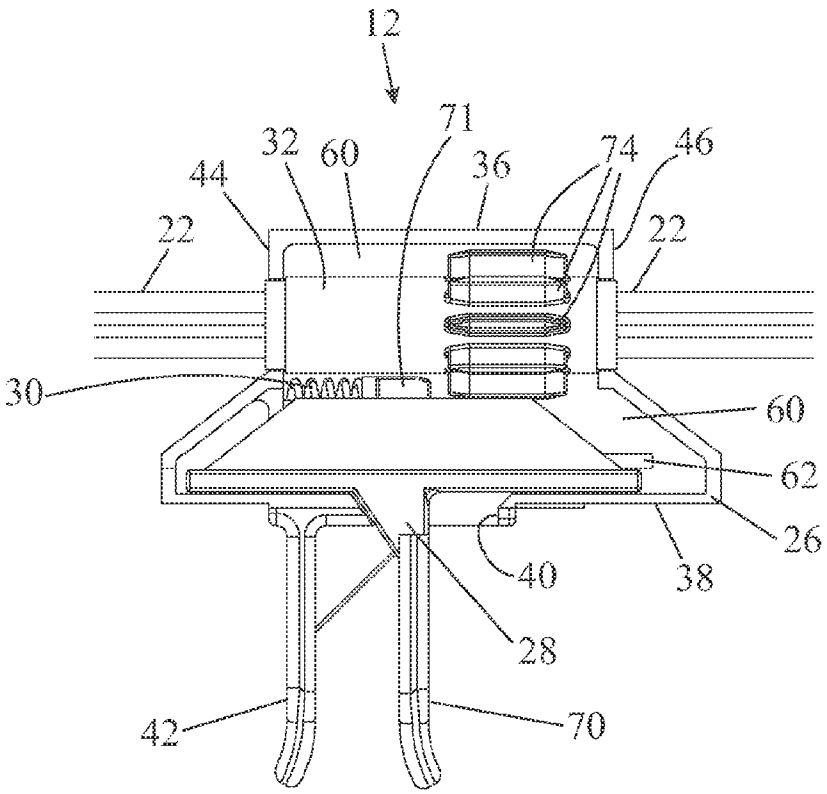
FIG. 5 is the same view as FIG. 4, but with the lock mechanism in the unlocked position.
Figure 6:
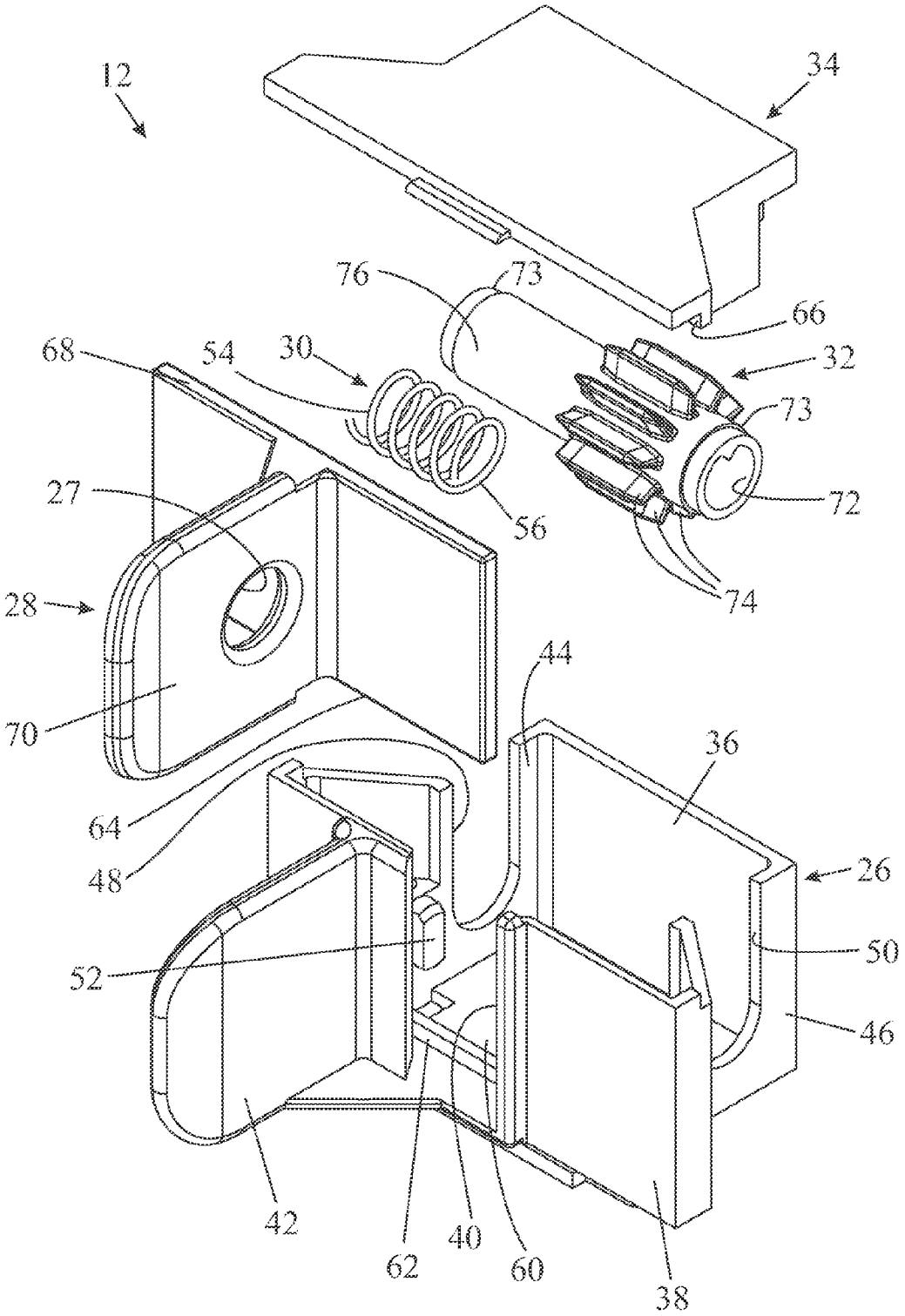
FIG. 6 is an exploded perspective view of the lock mechanism of FIG. 1.

FIGS. 4-9 show the details of the lock mechanism 12 of FIG. 3. Referring to FIG. 6, the lock mechanism 12 includes a housing 26, a slide element 28, a coil spring 30, a splined sleeve 32, and a housing cover 34.

The housing 26 is a substantially rectangular box having a flat back wall 36, a flat front wall 38 which defines an opening 40, and a forwardly extending fixed tab 42 secured to the front wall 38. The side walls 44, 46 define aligned, U-shaped openings 48, 50 which rotationally support the splined sleeve 32. The left side wall 44 also defines an inwardly extending projection 52 sized to receive and engage one end 54 of the coil spring 30. The other end 56 of the coil spring 30 is received in a similar projection 58 on the slide element 28 (See FIG. 7), as will be described in more detail later.

The bottom wall 60 defines a ridge 62 which extends parallel to the front and rear walls 38, 36. The bottom edge 64 of the slide element 28 is received in the space between the ridge 62 and the front wall 38, so the ridge 62 and front wall 38 form a track that guides the slide element 28 for lateral, sliding displacement parallel to the flat front wall 38 of the housing 26. A recessed shoulder 66 along the front of the housing cover 34 also extends parallel to the front wall 38. The top edge 68 of the slide element 28 is received between the front wall 38 and the shoulder 66 to provide a similar linear, lateral guiding function for the top edge 68 of the slide element 28, as described in more detail later.

Figure 7:
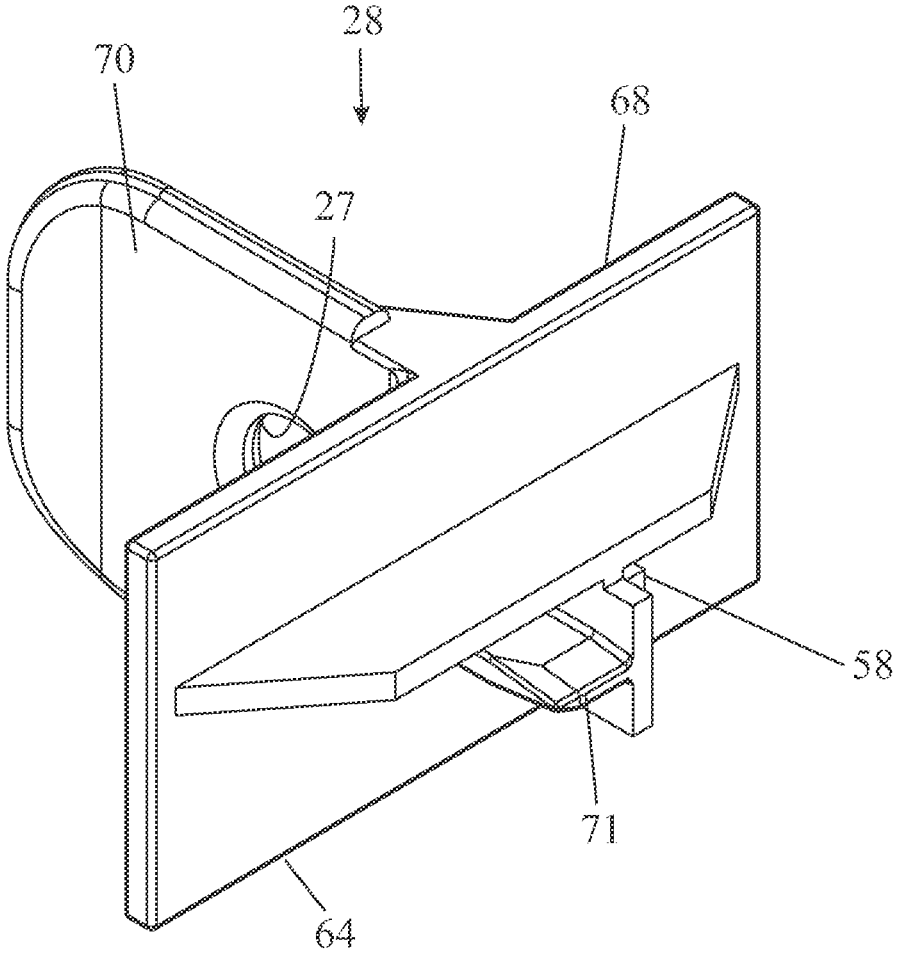
FIG. 7 is a rear perspective view of the slide element of the lock mechanism of FIG. 6.

Referring to FIG. 7, the slide element 28 is a substantially T-shaped member with the leg of the "T" being a slide tab 70 which is substantially identical to the fixed tab 42 of the housing 26, except that there is a through opening 27 through the slide tab 70, the purpose of which is described later. As best appreciated in FIGS. 4 and 5, the fixed tab 42 and the slide tab 70 are substantially parallel to each other when the lock mechanism 12 is assembled, and the slide element 28 slides to the left (as seen from the vantage point of FIGS. 4 and 5) toward the fixed tab 42 to unlock the lock mechanism 12, as described in more detail later.

Again referring to FIG. 7, the slide element 28 defines a wing projection 71 substantially opposite the spring-receiving projection 58. As described in more detail later, this wing projection 71 slides between the splines of the splined sleeve 32 to prevent the splined sleeve 32 from rotating.

The splined sleeve 32 (See FIGS. 6 and 9) is a hollow, generally cylindrical body with an internal bore 72 having a non-circular profile. In this particular embodiment, it has a "V" projection profile. The lift rod 22 has a complementary "V" notch 22A. The lift rod 22 is sized to nearly match the internal profile of the bore 72, with the "V" projection of the bore 72 being received in the "V" notch 22A of the lift rod 22, such that the splined sleeve 32 and the lift rod 22 are positively engaged to rotate together. Thus, when the splined sleeve 32 is prevented from rotation, the lift rod 22 is likewise prevented from rotation.

The splined sleeve 32 also defines a plurality of splines 74 extending radially at the right end portion of the splined sleeve 32 (as seen from the vantage point of FIG. 6). The left end portion 76 of the splined sleeve 32 is a smooth, spline-less, cylindrical surface having the same outside diameter as the base from which the splines 74 project.

Figure 4:
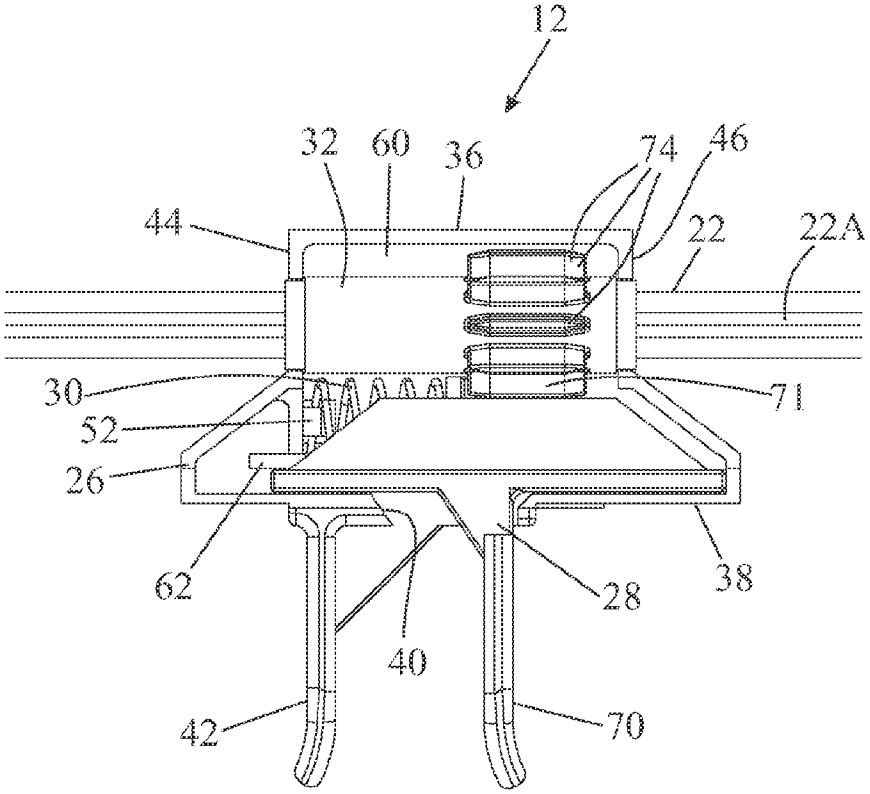
FIG. 4 is a plan view of the lock mechanism of FIG. 1, with the top cover omitted for clarity, and showing the lift rod.

Assembly:

Referring to FIGS. 4-6, to assemble the lock mechanism 12, the first end 54 of the coil spring 30 is placed over the projection 52 on the housing 26. The slide element 28 is then assembled such that the slide tab 70 projects through the opening 40 in the front wall 38 of the housing 26, with the bottom edge 64 of the slide element 28 fitting in the space between the ridge 62 and the front wall 38 of the housing 26. The second end 56 of the coil spring 30 receives the projection 58 (See FIG. 7) of the slide element 28, so the coil spring 30 is trapped between and is held in position by the two projections 52, 58.

The coil spring 30 acts as a biasing means which urges the slide element 28 to the right (as seen from the vantage point of FIG. 4). To install the splined sleeve 32, the user pushes the slide element 28 to the left, to the position shown in FIG. 5, such that the wing projection 71 clears the splines 74 of the splined sleeve 32. The splined sleeve 32 is then dropped into place so that its ends rest on the curved bottoms of the openings 48, 50 in the side walls 44, 46, which support the splined sleeve 32 for rotation. (Shoulders 73 near the ends of the splined sleeve 32 lie inside the housing 26 adjacent to the side walls 44, 46 and ensure that the splined sleeve 32 remains in the proper axial position relative to the housing 26.) Finally, the housing cover 34 snaps on top of the assembly to keep the components together, with top edge 68 of the slide element 28 being received between the shoulder 66 of the housing cover 34 and the front wall 38 of the housing 26, and the lift rod 22 is slid through the bore 72 of the splined sleeve 32 and through the lift stations 20 and into the spring motor 24, as shown in FIG. 3.

The assembled lock mechanism 12, lift rod 22, lift stations 20, and spring motor 24, are then mounted in the movable rail 16. In this embodiment, the movable rail 16 is the bottom rail 16, but it alternatively could be an intermediate rail, located between the head rail and a bottom rail (not shown). As another alternative, the entire mechanism, including the spring motor 24, lift rod 22, lift stations 20 and lock 12 could be located in the fixed head rail 14, with the lift cords secured to the movable bottom rail, extending through the shade 18, and winding up on the spools of the lift stations 20 in the fixed head rail.

Operation:

Referring to FIGS. 1, 2, 4, and 5, to raise or lower the shade 10, the user pinches together the tabs 42, 70 of the lock mechanism 12, which pushes the slide element 28 to the left (as seen in FIG. 5), against the biasing force of the coil spring 30. The wing projection 71 on the slide element 28 also moves to the left until it clears the splines 74 of the splined sleeve 32, which frees the splined sleeve 32 and allows it to rotate. The lift rod 22, which is functionally and positively connected to the splined sleeve 32, now is also free to rotate. When the user is raising the shade 10, the spring motor 24 assists the user by supplying some of the force required to rotate the lift rod 22 and with it the lift spools of the lift stations 20 to wind any lift cords onto these lift spools.

The spring on the spring motor 24 may be overpowered (more powerful than required to overcome the force of gravity acting on the shade 10 so that it raises the shade 10), or it may be underpowered, so that the user has to provide some of the lifting force to raise the shade 10. As discussed earlier, the spring in the spring motor 24 may include a spring with a negative power curve such that, when the force required to raise the blind is at a minimum (when the blind is fully extended), the spring motor 24 provides the least assist, and as a progressively greater lifting force is required to raise the blind (as the blind approaches the fully retracted position) the spring motor 24 provides more of an assist.

Figure 9:
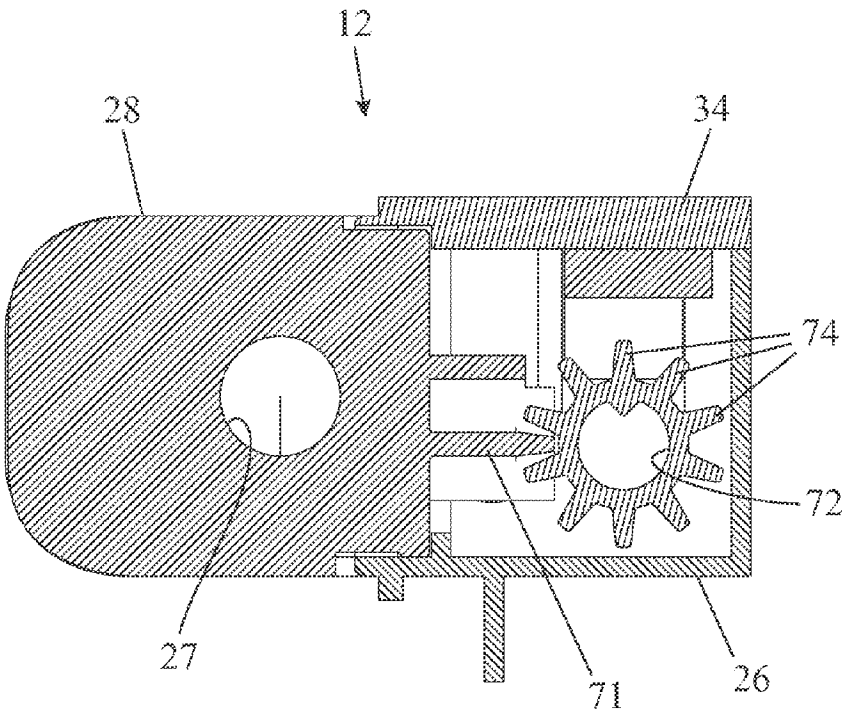
FIG. 9 is a section view along line 9-9 of FIG. 8.
Figure 8:
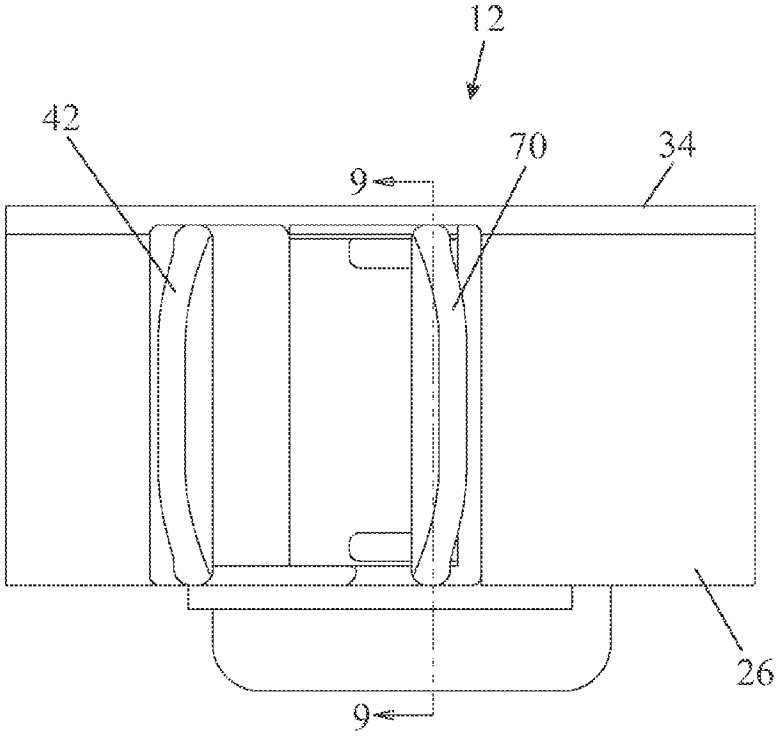
FIG. 8 is a front view the lock mechanism of FIG. 1.

When the user releases the tabs 42, 70 of the lock mechanism 12, the coil spring 30 automatically pushes the slide element 28 to the right, as shown in FIG. 4, which slides the wing projection 71 to the right, so that it enters between two of the splines 74, as shown in FIG. 9. This prevents the splined sleeve 32 from rotating further. Since the lift rod 22 is directly connected to the splined sleeve 32, this also prevents the lift rod 22 and the lift stations, which are functionally connected to the lift rod 22, from rotating, so the lift cords cannot unwind from their lift stations 20, and the shade 10 remains in the position where it was released by the user.

FIGS. 10-15 depict the shade 10 with an enhancement that may be added to make the lock 12 more readily accessible, especially when it might otherwise be too high up to reach.

Figure 10:
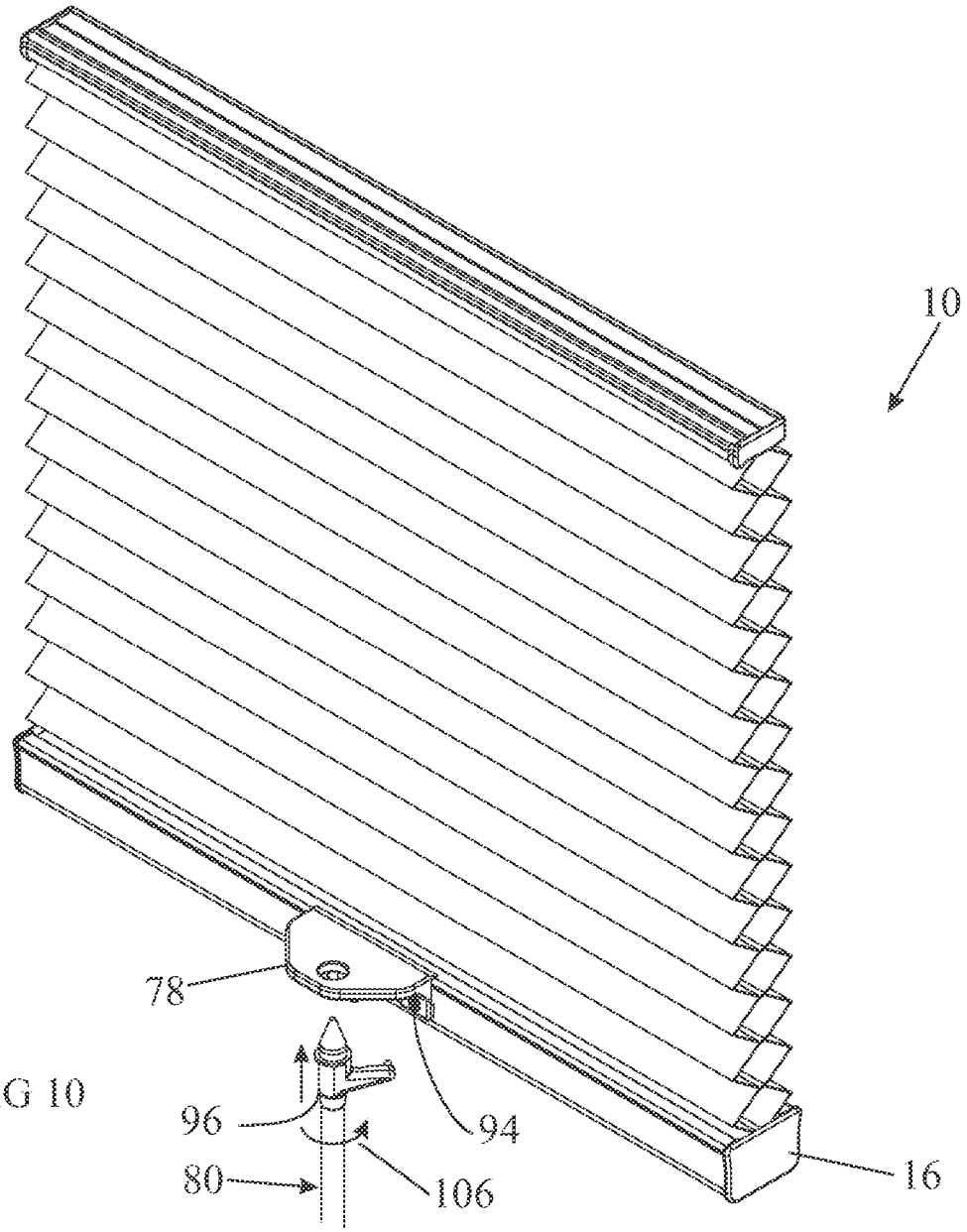
FIG. 10 is a perspective view of the cellular shade of FIG. 1, but adding a pivot support attachment to aid in unlocking the shade if the lock mechanism is not readily accessible to the user.
Figure 11:
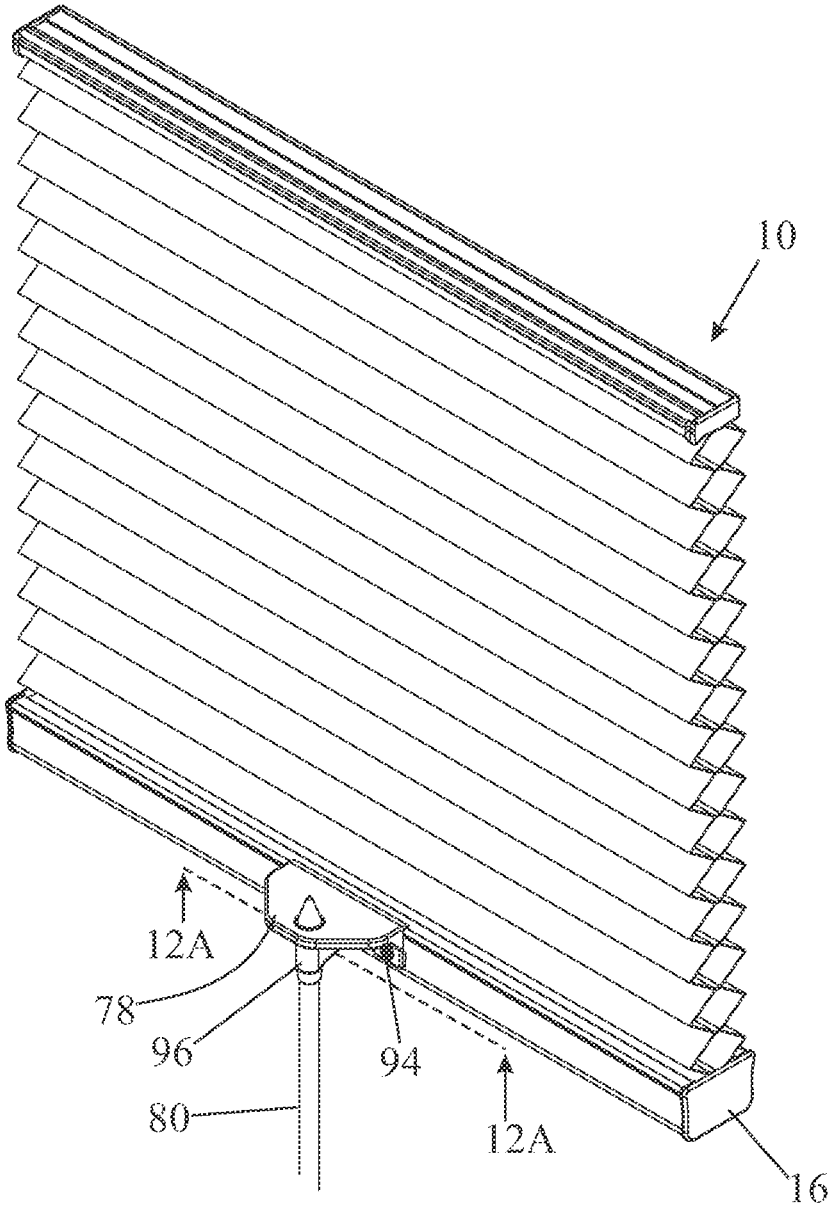
FIG. 11 is a perspective view, similar to FIG. 10, showing a lock release wand engaging the pivot support attachment for aiding in unlocking the shade.
Figure 12B:
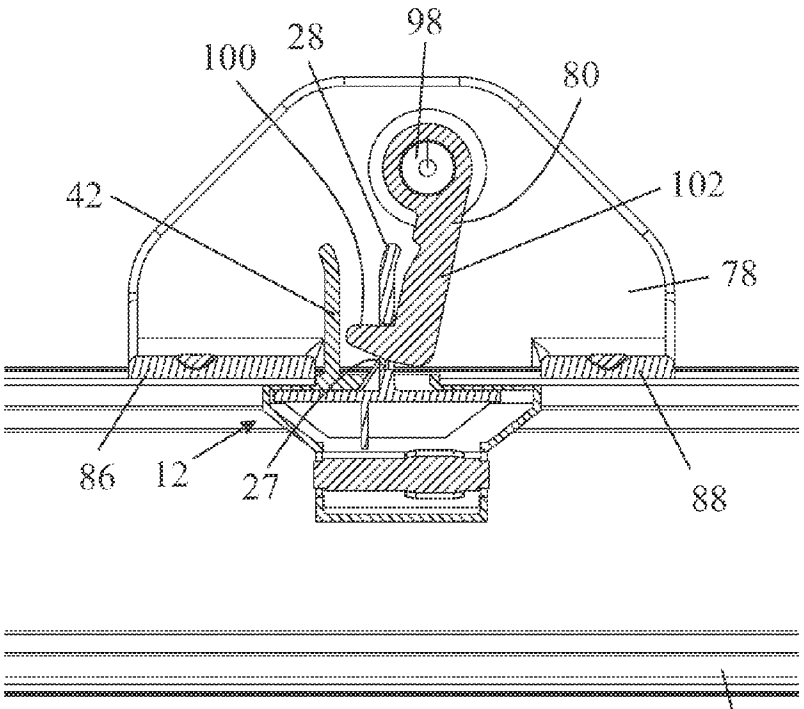
FIG. 12B is the same view as FIG. 12A, but with the lock mechanism in the unlocked position.
Figure 12A:
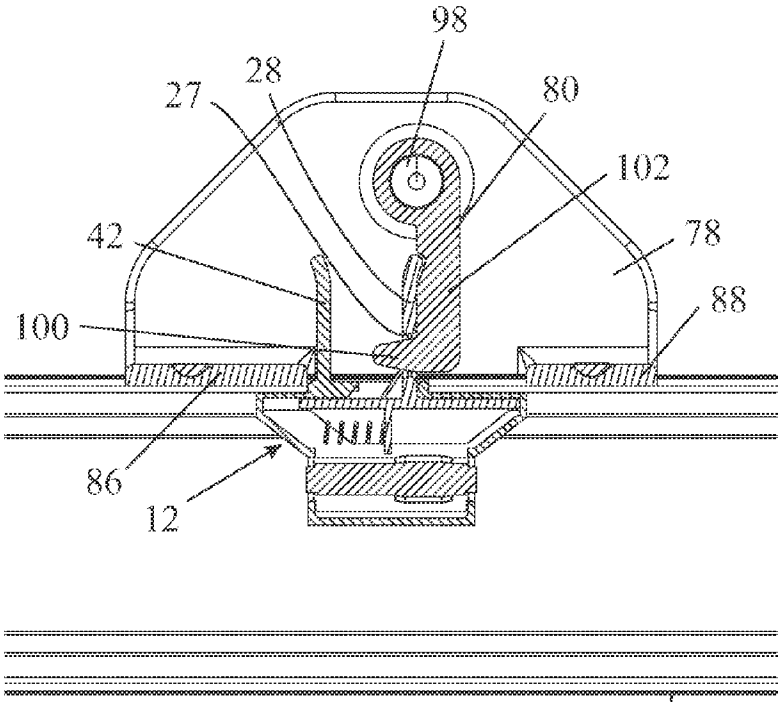
FIG. 12A is a broken-away, section view along line 12A-12A of FIG. 11.
Figure 13:
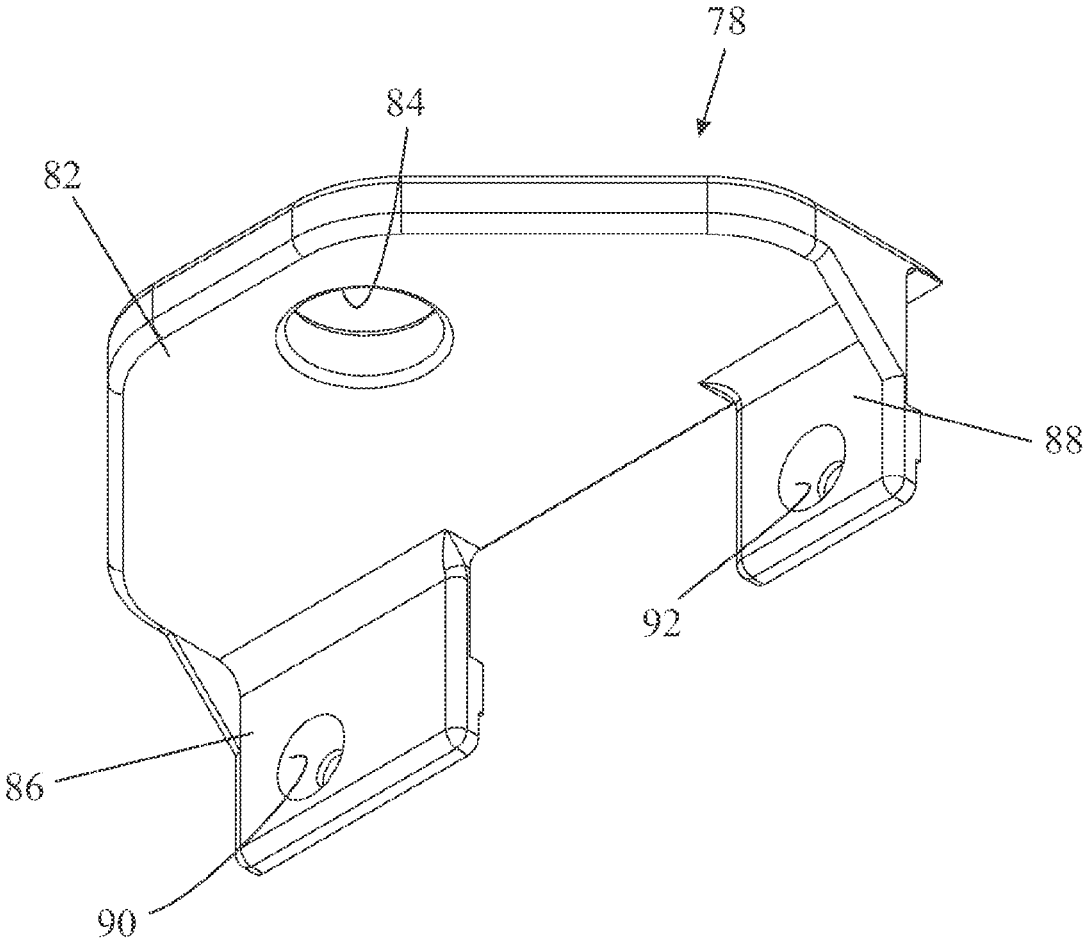
FIG. 13 is a perspective view of the pivot support attachment of FIG. 11.

Referring to FIGS. 10 and 11, the enhancement includes a pivot support attachment 78 and a lock release wand 80. Referring to FIG. 13, the pivot support attachment 78 has a substantially flat horizontal surface 82, defining a circular through opening 84, and two downwardly projecting ears 86, 88 defining countersunk openings 90, 92, for receiving screws to secure the attachment 78 to the movable rail 16. As seen in FIGS. 10 and 11, the pivot support attachment 78 is attached to the front, outside surface of the bottom rail 16 via screws 94.

Figure 14:
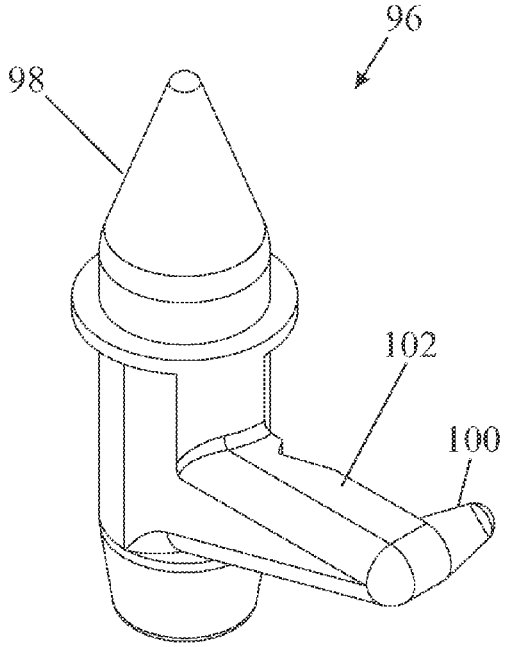
FIG. 14 is a perspective view of the tip of the lock release wand of FIGS. 10 and 11.
Figure 15:
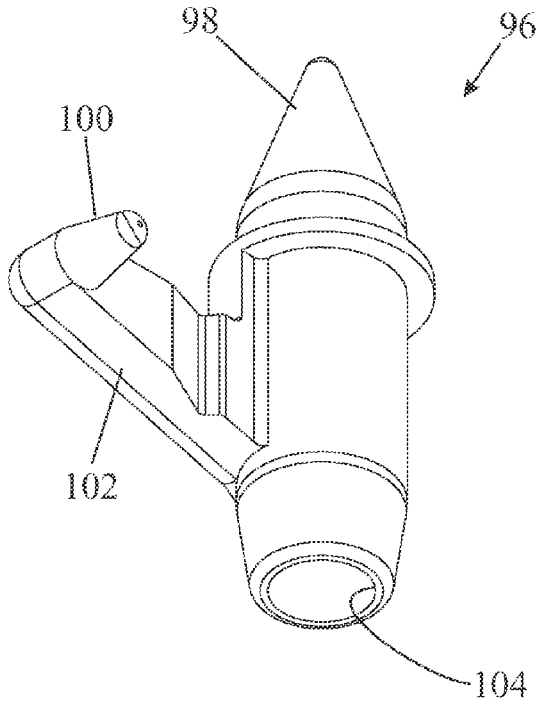
FIG. 15 is a perspective view of the tip of the lock release wand of FIG. 14, as seen from a different angle.

FIGS. 14 and 15 show the engagement tip 96, which is secured to the top of the lock release wand 80 (See FIG. 11). This engagement tip 96 defines a first frustoconical surface 98 coaxial with the longitudinal axis of the lock release wand 80, and a second frustoconical surface 100 mounted on an arm 102 which projects radially from the engagement tip 96. The second frustoconical surface 100 is oriented perpendicular to the arm 102. The bottom of the engagement tip 96 defines an opening 104 which receives the end of the lock release wand 80, as seen in FIG. 10.

If it is desirable to have means for extending the reach of the user to raise or lower the shade 10, the pivot support attachment 78 is attached (using screws 94, for instance) to the outer surface of the bottom rail 16 such that the two ears 86, 88 straddle the lock 12 and the ear 86 abuts the fixed tab 42 of the lock 12. The lock release wand 80 is then inserted into the pivot support attachment 78 such that the first frustoconical surface 98 goes into the opening 84, as shown in FIGS. 10 and 11. This first action properly locates the lock release wand 80 relative to the pivot support attachment 78 in preparation for controlling the lock 12.

Once the lock release wand 80 is in position, as shown in FIG. 11, it is rotated in a counter-clockwise direction about its longitudinal axis, as depicted by the arrow 106 in FIG. 10, until the second frustoconical surface 100 projects into the opening 27 (See FIG. 12A) in the slide tab 28 of the lock 12, and the arm 102 is pressing against the slide tab 28. Further rotation in the same counter-clockwise direction results in the arm 102 pushing the slide tab 28 toward the fixed tab 42, which unlocks the lock 12 (See FIG. 12B). The shade 10 may now be raised or lowered by raising or lowering the lock release wand 80. The second frustoconical surface 100 projecting through the opening 27 of the slide tab 28 creates a positive engagement between the lock release wand 80 and the lock 12 such that the lock release wand 80 does not separate from the lock 12 even when pulling down on the lock release wand 80.

Once the shade 10 is in the desired position, the user rotates the lock release wand 80 in a clockwise direction which allows the spring 30 to urge the slide tab 28 back to the locking position. Further rotation of the lock release wand 80 pulls the second frustoconical surface 100 out of the opening 27 in the slide tab 28 and allows the user to pull down on and remove the lock release wand 80.

Top-Down, Bottom-Up Shade

Figure 16:
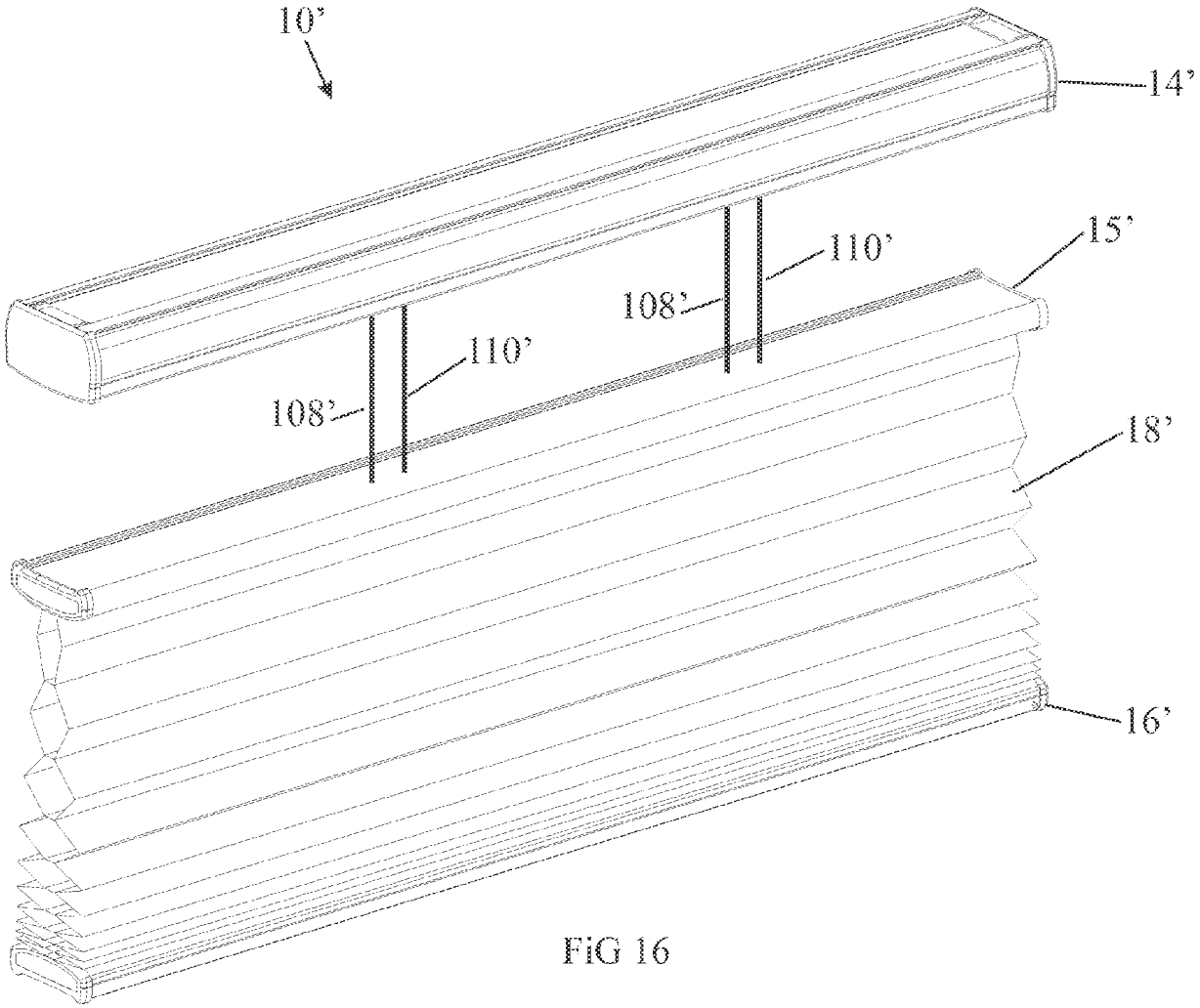
FIG. 16 is a perspective view of a top-down bottom-up cellular shade.
Figure 17:
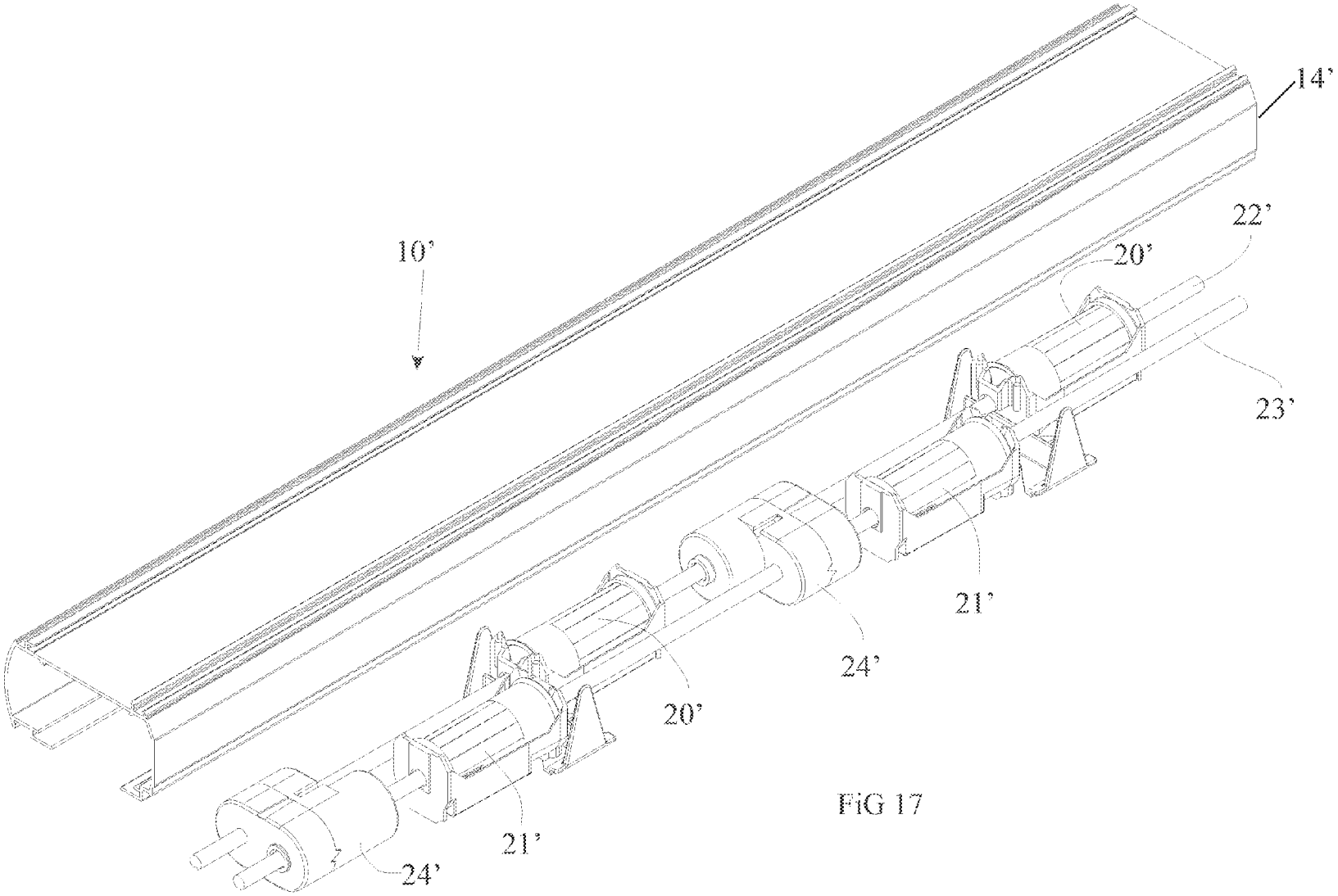
FIG. 17 is an exploded perspective view of the head rail of the cellular shade of FIG. 16.

FIGS. 16 and 17 show a top-down, bottom-up cellular shade 10'. This general type of shade 10' is described in the aforementioned U.S. Pat. No. 7,740,045 "Spring Motor and Drag Brake for Drive for Coverings for Architectural Openings", issued Jun. 22, 2010, which is hereby incorporated herein by reference.

The shade 10' includes a head rail 14', a movable intermediate rail 15', a movable bottom rail 16', and a cellular shade structure 18' suspended from the intermediate rail 15' and attached to both the intermediate rail 15' and the bottom rail 16'.

There is a first set of lift cords 108' that extend from the head rail 14' to the intermediate rail 15'. These first lift cords 108' have first ends attached to lift stations 21' located in the head rail 14' and second ends attached to the intermediate rail 15'. These first lift cords 108' are raised and lowered with the rotation of a first lift rod 23'.

There is a second set of lift cords 110' that extend from the head rail 14' to the bottom rail 16'. These second lift cords 110' have first ends attached to lift stations 20' in the headrail 14', extend through the intermediate rail 15' and through the covering 18' and have second ends attached to the bottom rail 16'. These second lift cords 110' are raised and lowered with the rotation of a second lift rod 22'. Other components include spring motors with drag brakes 24', as described below.

The first lift rod 23' extends through the lift stations 21'. A spring motor with drag brake 24' is functionally attached to the first lift rod 23' to provide an assisting force when raising the intermediate rail 15' of the shade 10'. When the first lift rod 23' rotates, the lift spools on the lift stations 21' also rotate, and the lift cords 108' wrap onto or unwrap from the lift stations 21' to raise or lower the intermediate rail 15'.

The second lift rod 22' extends through the lift stations 20' in the headrail 14'. A spring motor with drag brake 24' is functionally attached to the second lift rod 22' to provide an assisting force when raising the bottom rail 16' of the shade 10'. When the second lift rod 22' rotates, the lift spools on the lift stations 20' also rotate, and the lift cords 110' wrap onto or unwrap from the lift stations 20' to raise or lower the bottom rail 16'.

This arrangement results in two sets of lift cords 108', 110' extending adjacent to each other, with both of these two sets of lift cords 108', 110' being exposed as the intermediate rail 15' travels down toward the bottom rail 16'.

Figure 18:
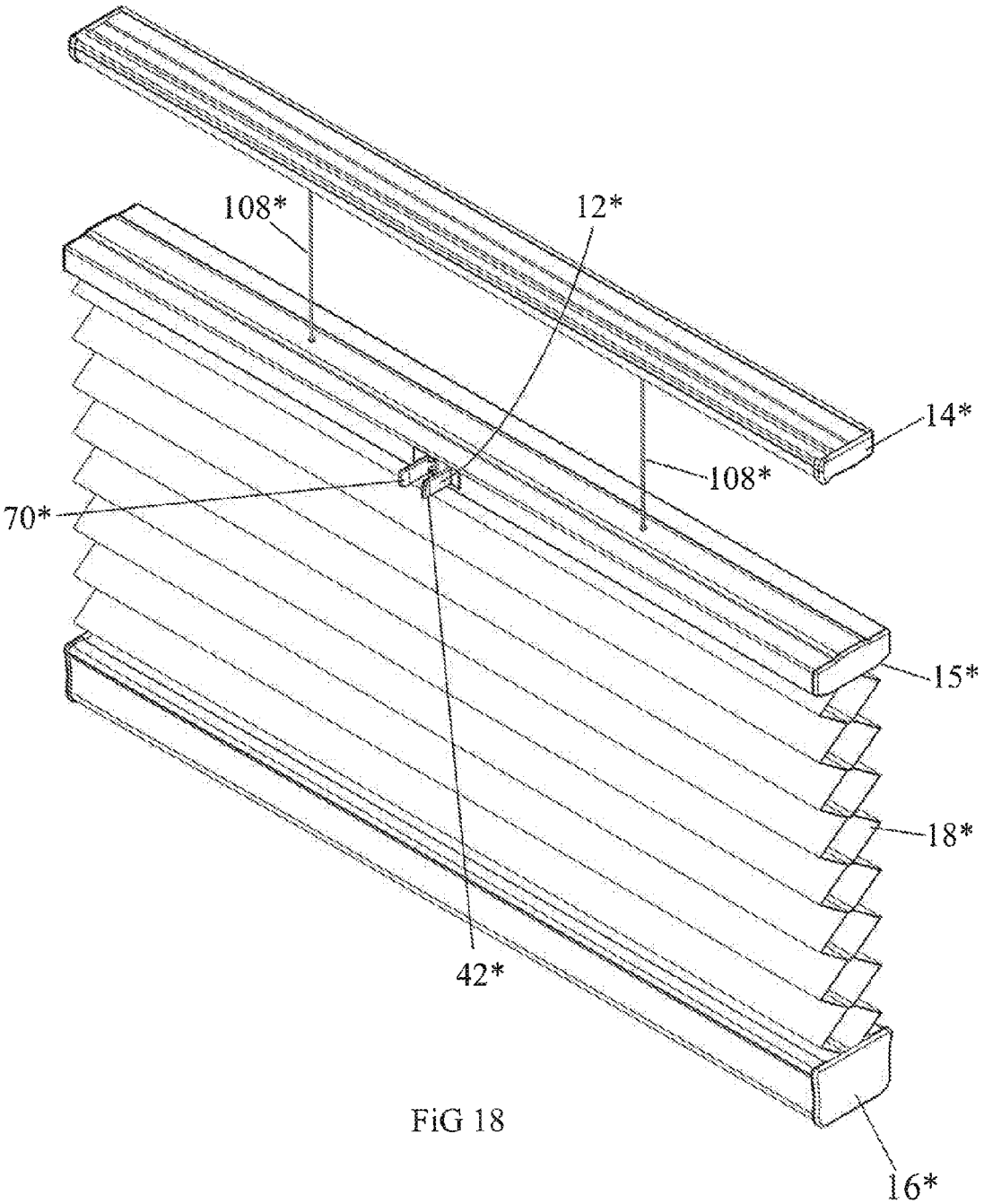
FIG. 18 is a perspective view of a top-down bottom-up cellular shade with a movable rail including a lock.
Figure 19:
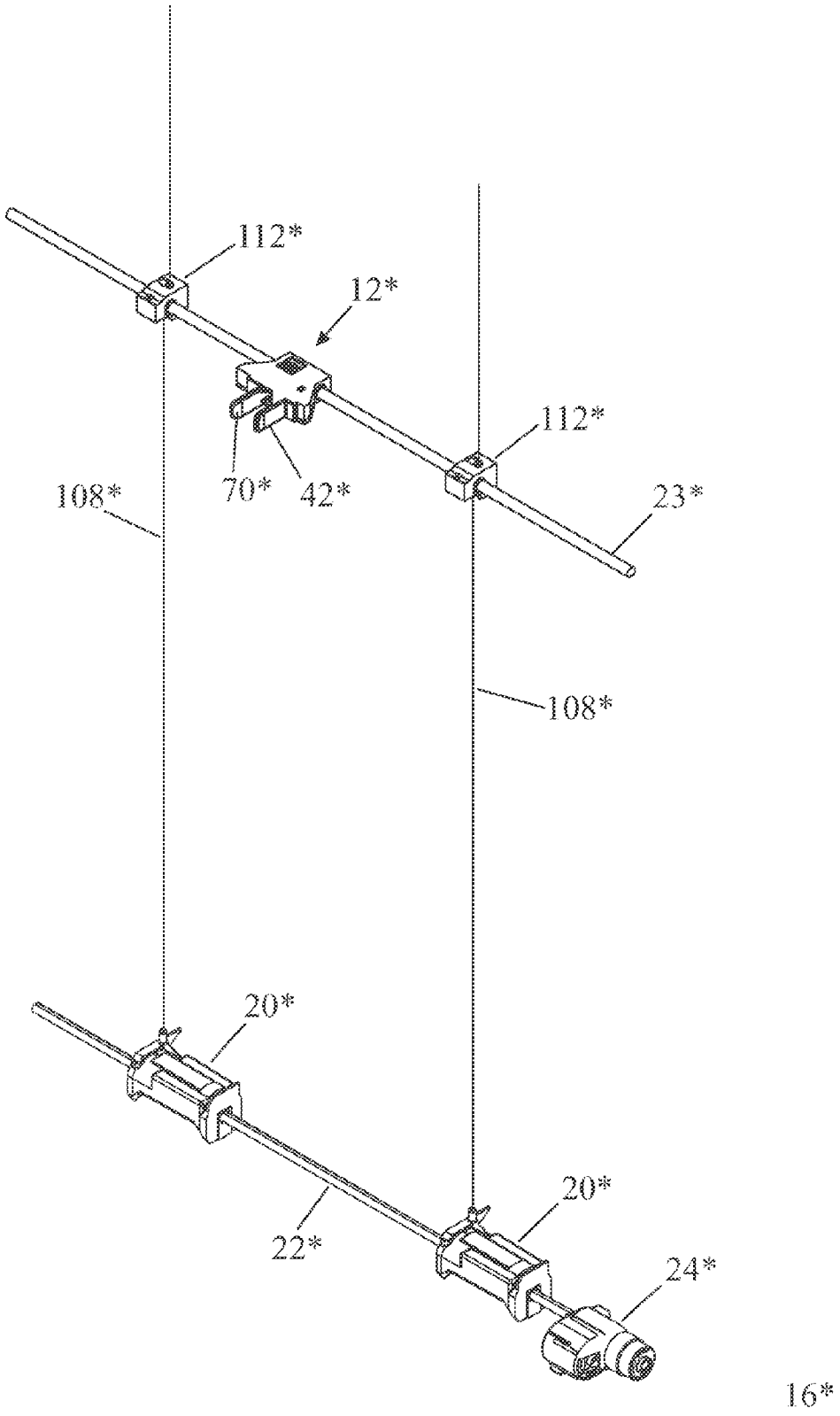
FIG. 19 is a partially broken away, perspective view of the cellular shade of FIG. 18, with the rails omitted for clarity.
Figure 20:
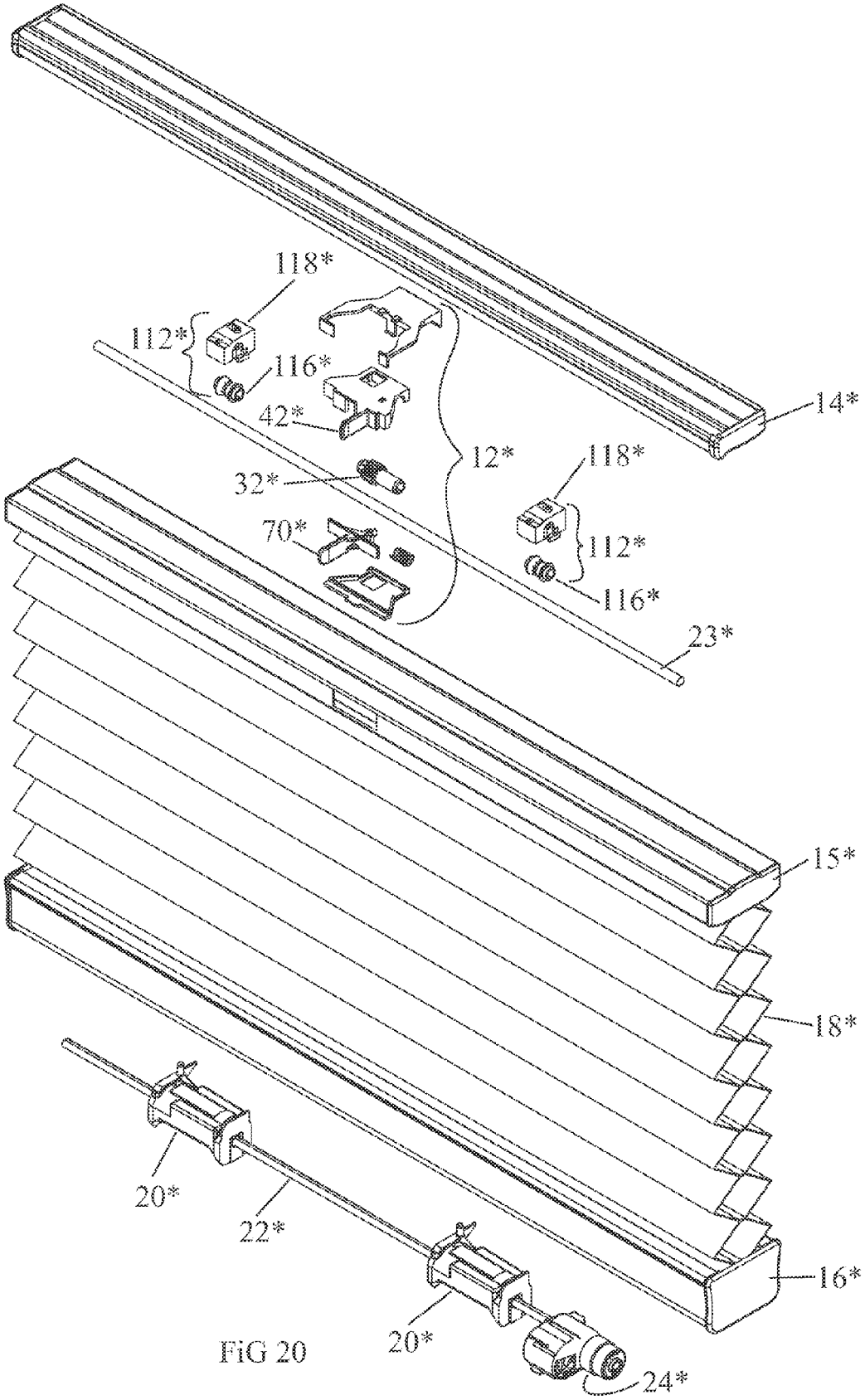
FIG. 20 is an exploded perspective view of the cellular shade of FIG. 18, with the lift cords omitted for clarity.

Arrangement with Intermediate Rail Riding on Lift Cords of Lower Rail:

FIGS. 18-20 show a top-down/bottom-up cellular shade 10*, which eliminates one of the sets of lift cords from the embodiment of FIG. 16. As explained in more detail below, a single set of lift cords 108* extends from the head rail 14*, through the intermediate rail 15*, through the covering 18*, and on down to the bottom rail 16*.

The shade 10* of FIGS. 18-20 includes a head rail 14*, an intermediate rail 15*, a bottom rail 16*, and a cellular shade structure 18* suspended from the intermediate rail 15* and attached to both the intermediate rail 15* and the bottom rail 16*.

Single lift cords 108* are attached to the head rail 14*, extend through a set of windlass assemblies 112* in the intermediate rail 15*, and then on through openings in the cellular shade 18*, to terminate at lift stations 20* housed in the bottom rail 16*. A lift rod 22* extends through the lift stations 20* in the bottom rail 16*. When the lift rod 22* rotates, the lift spools on the lift stations 20* also rotate, and the lift cords 108* wrap onto or unwrap from the spools on the lift stations 20* to raise or lower the bottom rail 16*. A spring motor with drag brake 24* is functionally attached to the lift rod 22* to provide an assisting force when raising the bottom rail 16* and to hold the bottom rail 16* in place when released by the user.

A connecting rod (or lift rod) 23* in the intermediate rail 15* extends through the locking mechanism 12* and through the windlass assemblies 112* to functionally interconnect them as described later.

The spring motor with drag brake 24* in the movable bottom rail 16* of FIGS. 19 and 20 is identical to the spring motor with drag brake 24' of FIG. 17, including the possibility of incorporating overpowered or underpowered springs, as well as the possibility of incorporating a spring with a negative power curve as has already been discussed. The lift stations 20* of FIGS. 19 and 20 are substantially identical to the lift stations 20', 21' of FIG. 17, which has already been described. Finally, the locking mechanism 12* of FIGS. 19 and 20 is substantially identical in design and operation to the locking mechanism 12 of FIG. 3, which already has been described.

The windlass assemblies 112* shown in FIGS. 19 and 20 are shown in more detail in FIGS. 21-26. Each windlass assembly 112* includes a windlass (or capstan) 116* and a windlass housing 118*. The windlass (or capstan) 116* is a spool that rotates within the windlass housing 118*. The windlass housing 118* is a substantially rectangular housing with a top wall 120*, a front wall 122*, a rear wall 124*, a right wall 126*, and a left wall 128*, which define a hollow cavity 130* for rotationally housing the windlass spool 116*. The windlass spool 116* is assembled to the windlass housing 118* through the bottom of the windlass housing 118* as discussed below.

The right and left walls 126*, 128* include arms 132*, 134* respectively, which, in turn, define ramps 136*, 138* respectively which rotationally support the windlass spool 116*, as described in more detail later. The top wall 120* defines a cord entry port 140*, and the bottom of the windlass housing 118* defines a cord outlet port 142*. Finally, a biasing member 144*, resembling a paddle or a flat finger, projects downwardly inside the cavity 130*, adjacent the windlass spool 116*, as best appreciated in FIGS. 21, 23, and 24. As explained in more detail later, the purpose of the biasing member 144* is to press the windings of the lift cord 108* against the ribs 145* (See FIG. 23) of the windlass spool 116* to prevent slippage between the lift cord 108* and the windlass spool 116*, that is, to prevent the possibility of the lift cord 108* surging the windlass spool 116*.

Figure 23:
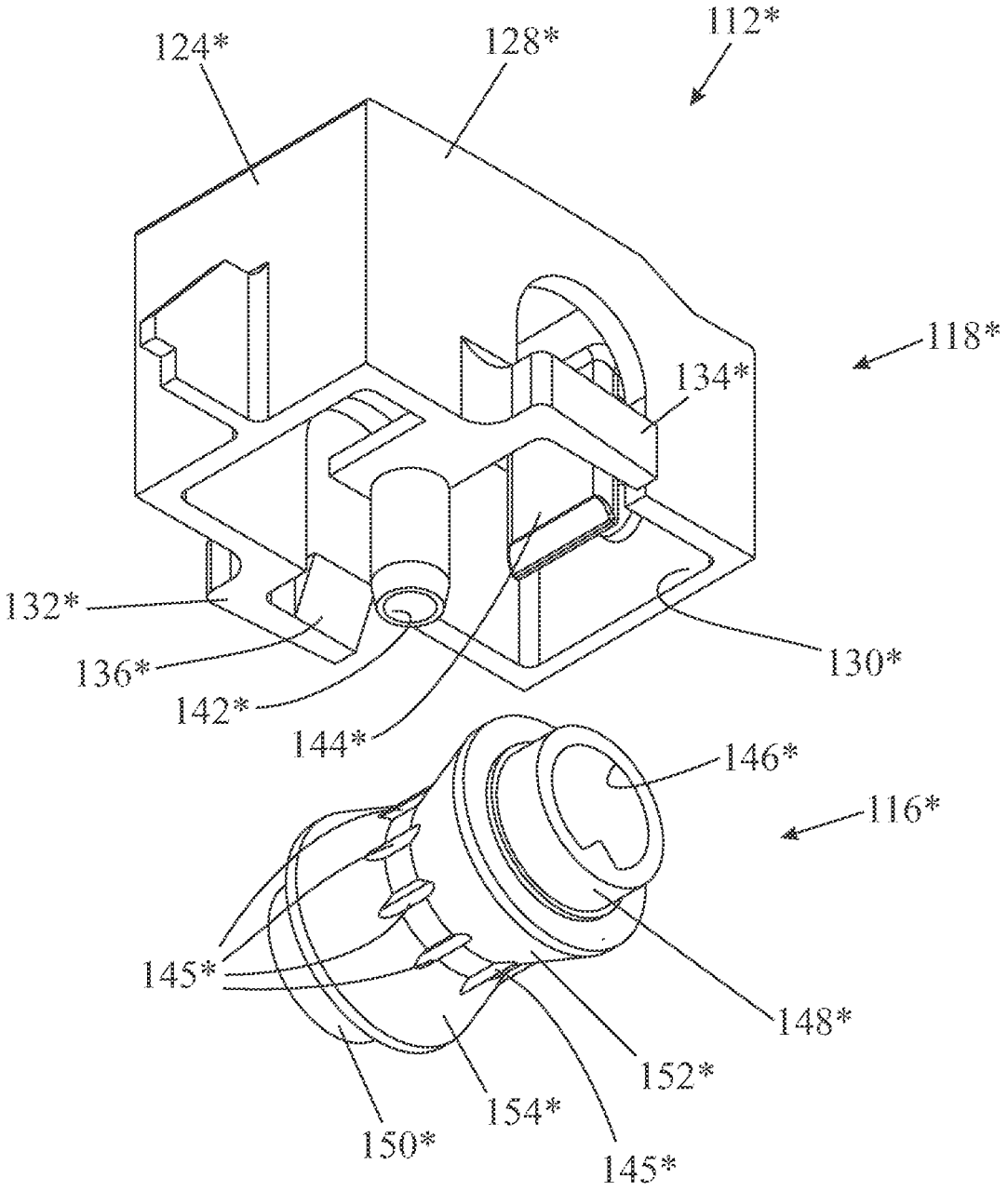
FIG. 23 is an exploded perspective view of the windlass assembly of FIG. 22.
Figure 24:
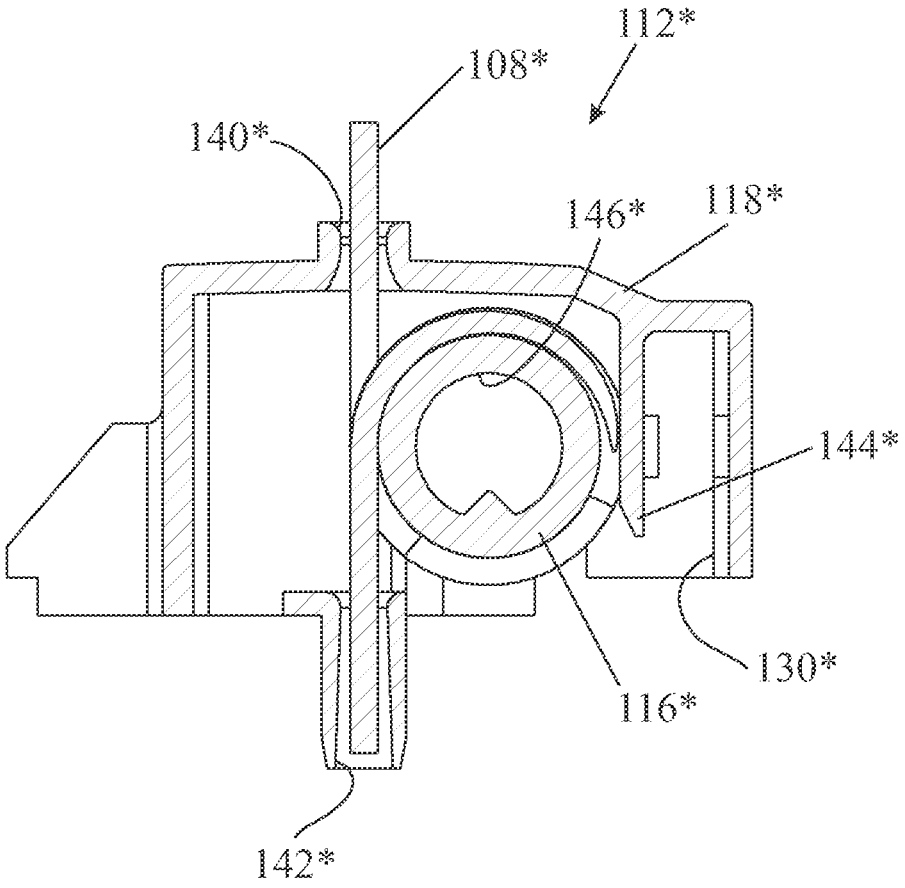
FIG. 24 is section view along line 24-24 of FIG. 22.
Figure 25:
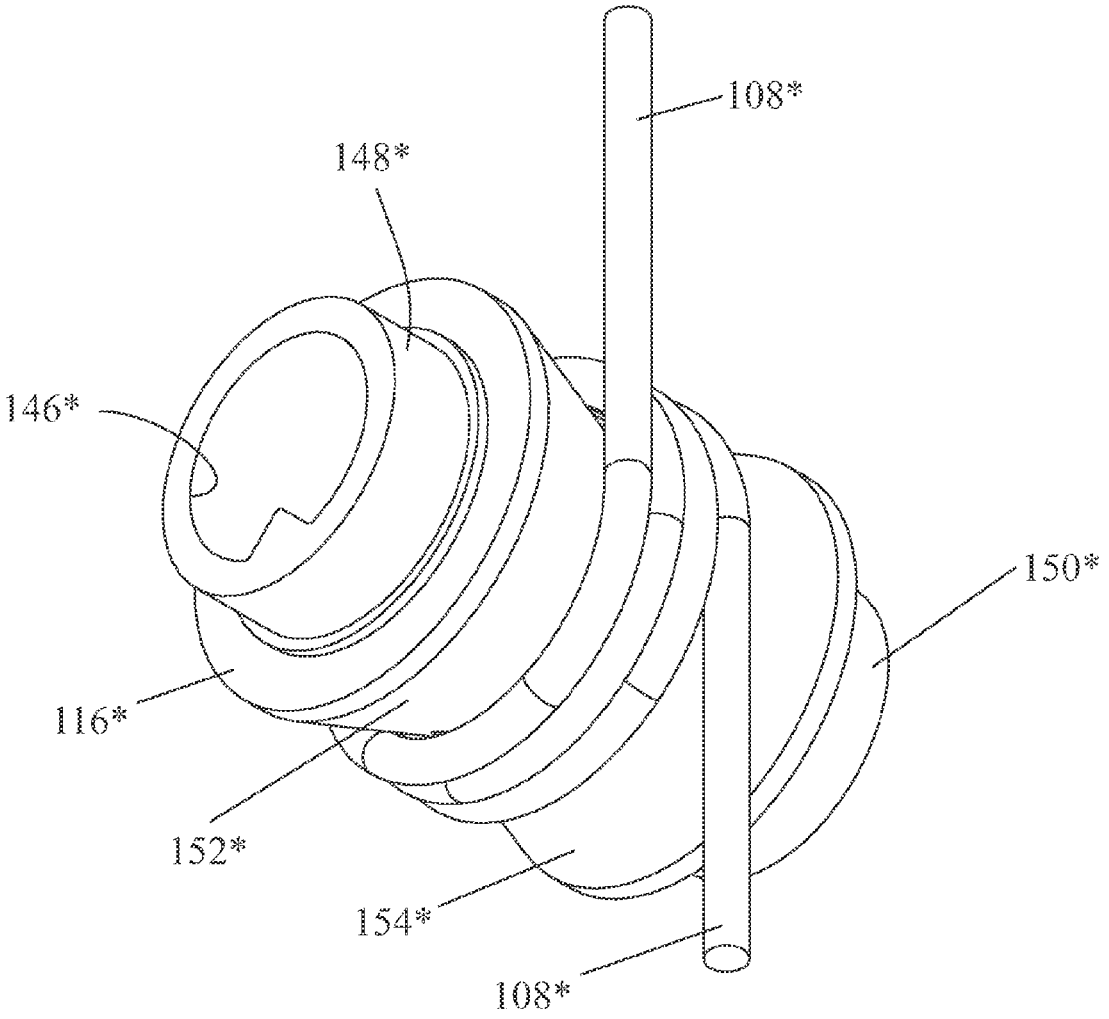
FIG. 25 is a perspective view of the windlass of FIG. 24.

Referring to FIGS. 23 and 25, the windlass spool 116* is a hollow, cylindrical body with an internal bore 146* having a non-circular profile. In this particular embodiment, it has a "V" projection profile. The connecting rod 23* has a "V" notch and it is sized to nearly match the internal profile of the bore 146*, with the "V" projection of the bore 146* being received in the "V" notch of the connecting rod 23*, such that the windlasses (or capstans) 116* of the windlass assemblies 112* and the connecting rod 23* are positively engaged to rotate together. The windlass spool 116* defines two coaxial frustoconical surfaces 152*, 154* tapering from a larger diameter at the end to a smaller diameter toward the center, and these surfaces are interconnected by a coaxial, generally cylindrical surface with a plurality of friction-enhancing, spaced apart ribs 145*.

Figure 21:
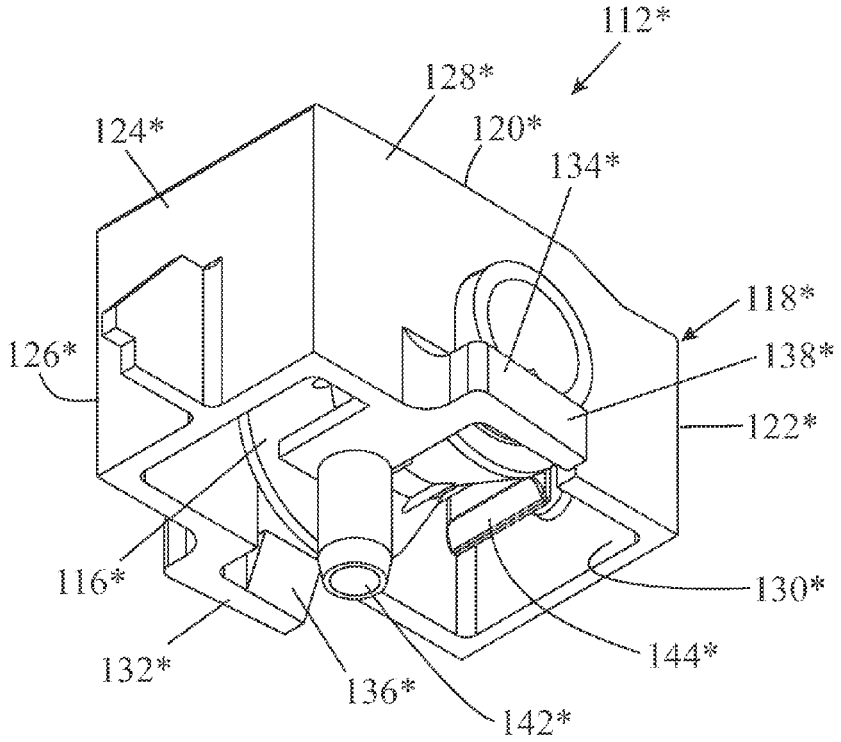
FIG. 21 is a bottom-end perspective view of one of the windlass assemblies of FIG. 20.
Figure 22:
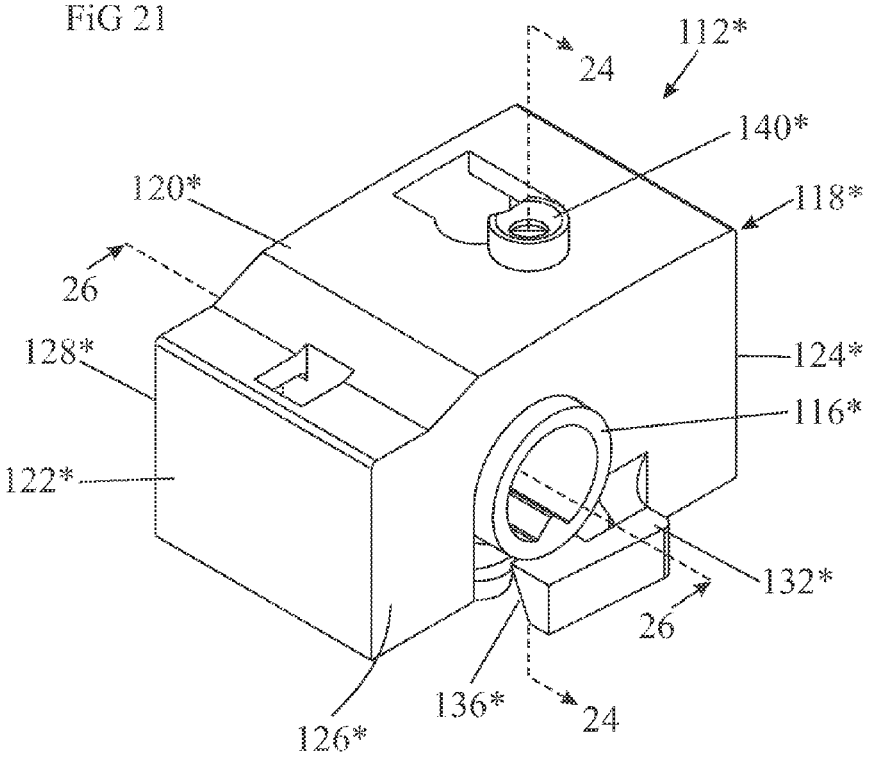
FIG. 22 is a top-end perspective view of the windlass assembly of FIG. 21.
Figure 26:
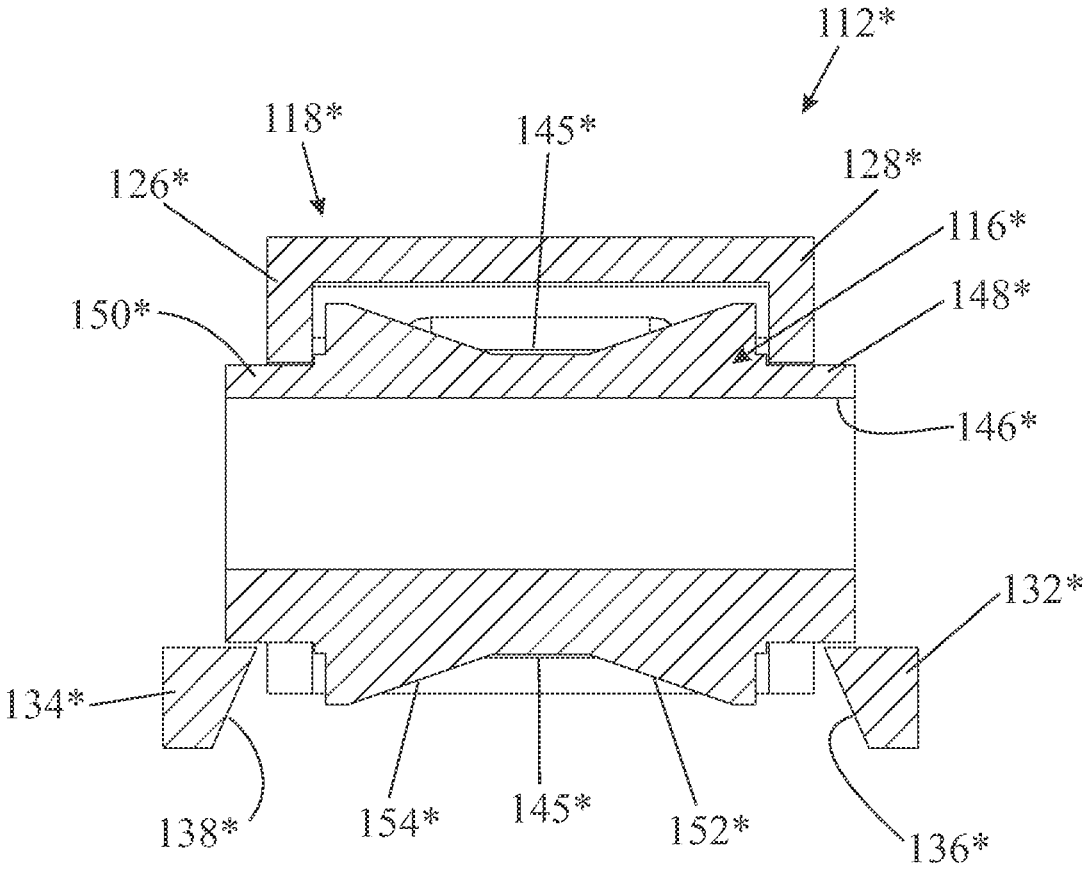
FIG. 26 is section view along line 26-26 of FIG. 22.
Figure 27:
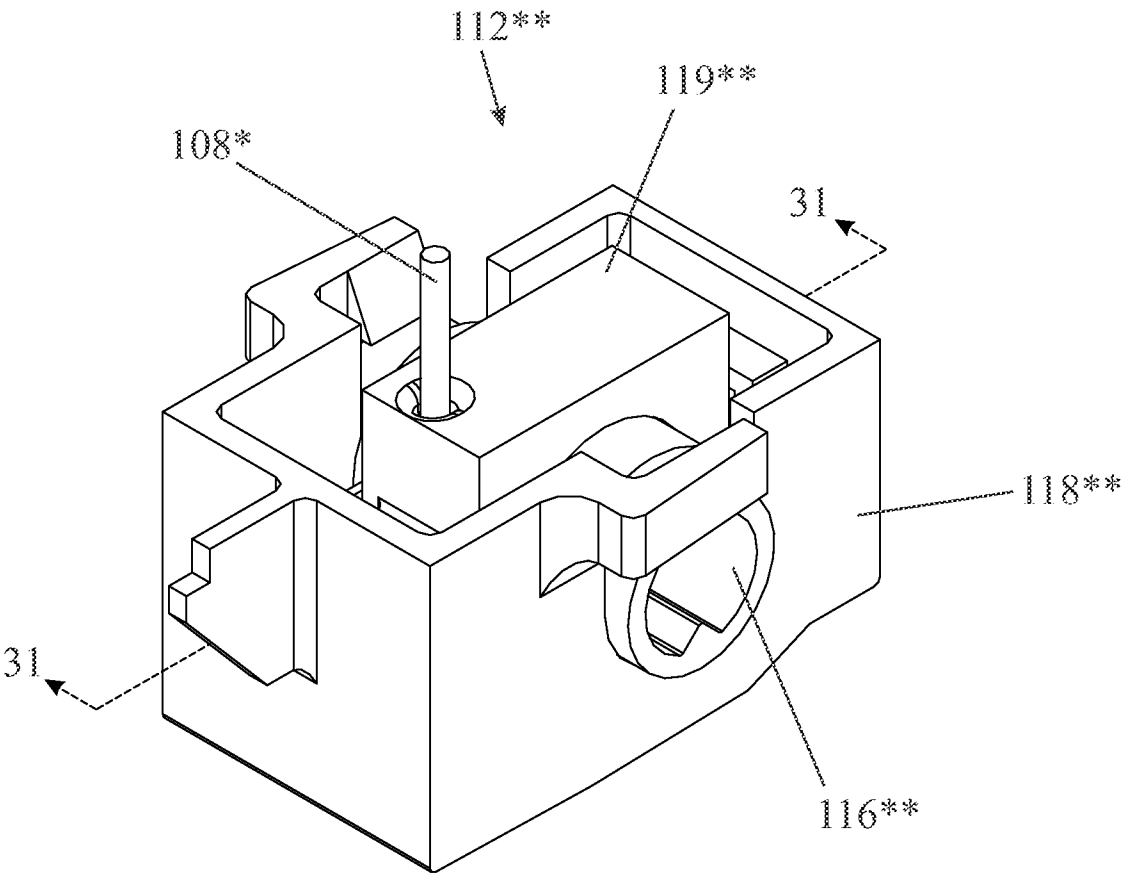
FIG. 27 is a perspective view of an alternate windlass assembly which may be used in the cellular shade of FIG. 20.
Figure 28:
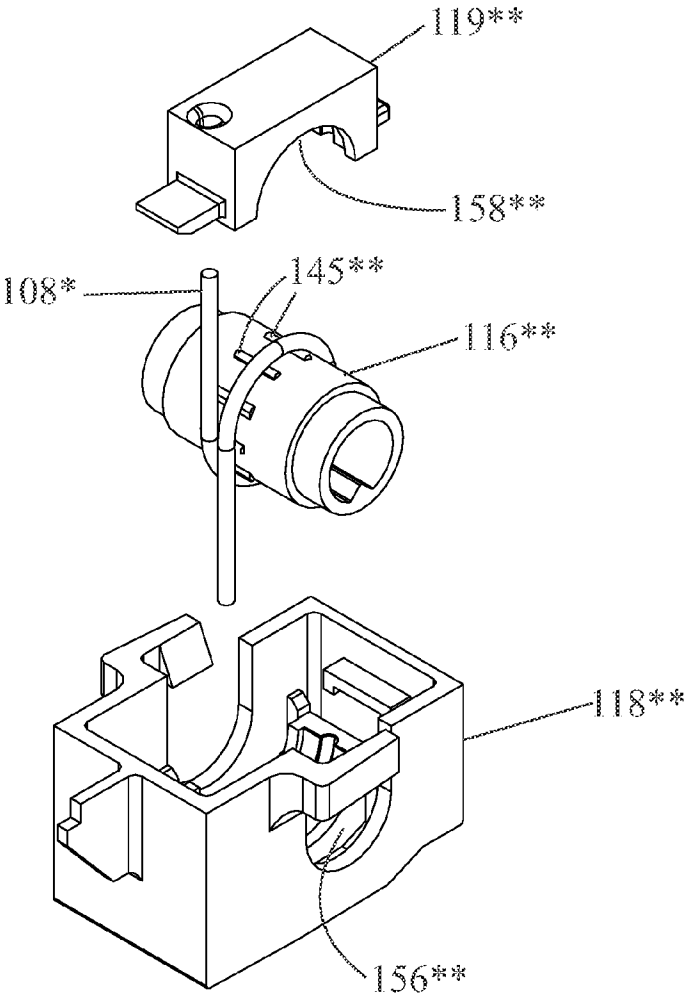
FIG. 28 is an exploded perspective view of the windlass assembly of FIG. 27.
Figure 29:
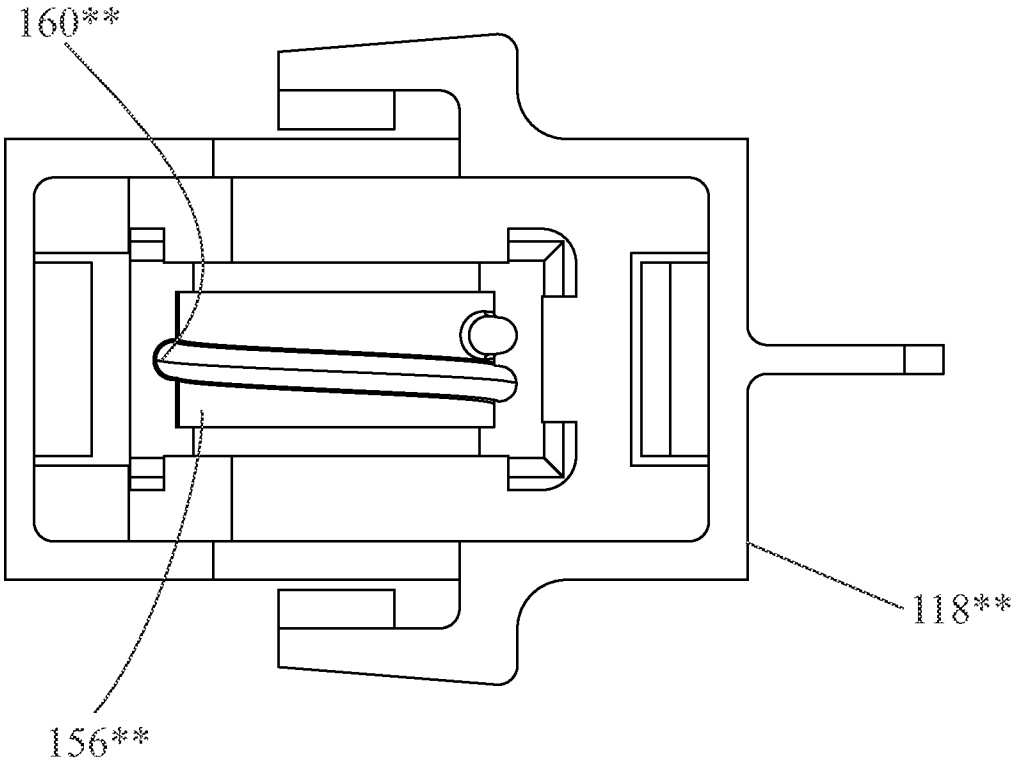
FIG. 29 is a plan view showing the housing of the windlass assembly of FIG. 28.
Figure 30:
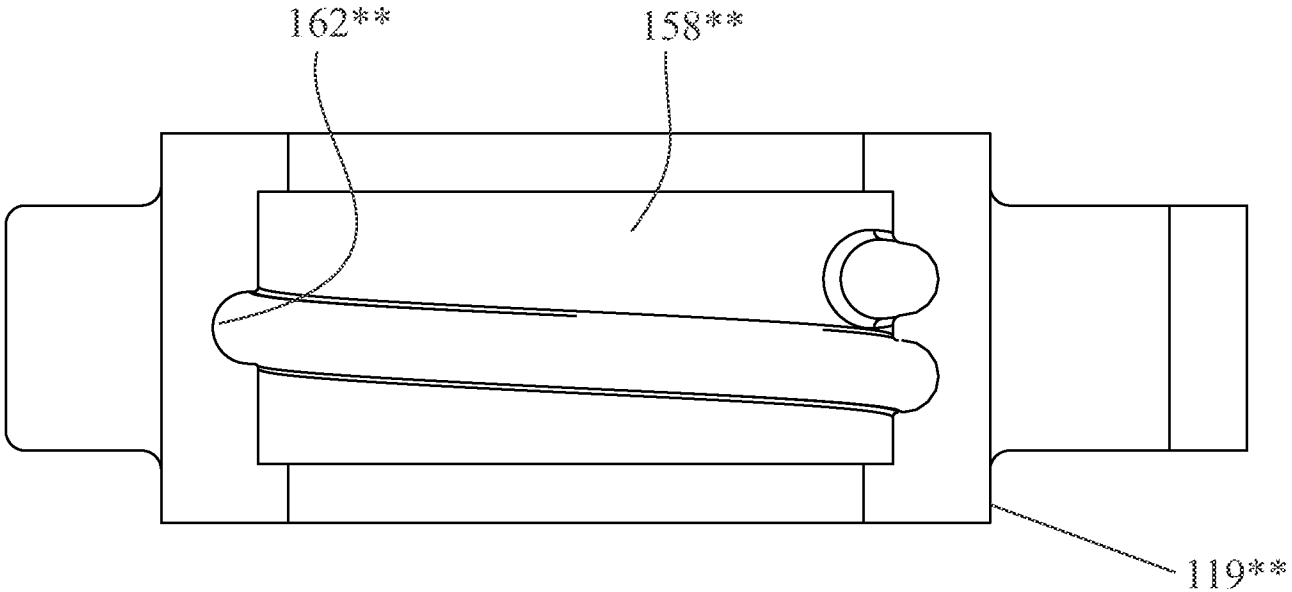
FIG. 30 is a plan view showing the housing cover of the windlass assembly of FIG. 28.
Figure 31:
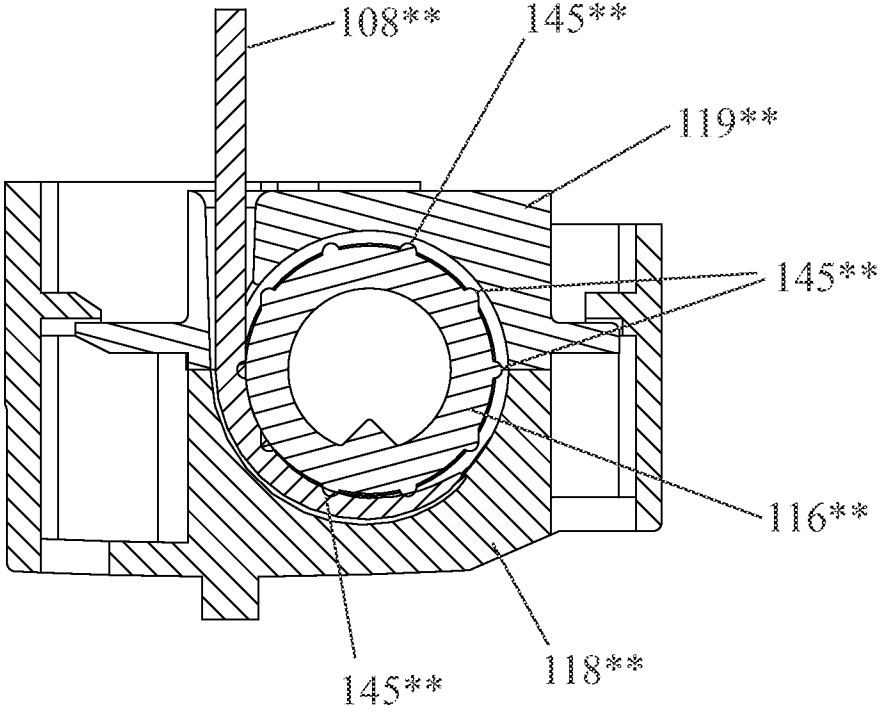
FIG. 31 is a section view along line 31-31 of FIG. 27.

To assemble the windlass assembly 112*, a first end of the lift cord 108* is fed up through the cord exit port 142 in the bottom of the housing 118* into the cavity 130* of the housing 118*, then is pulled downwardly out through the open bottom of the housing 118* and is wound one or more times around the central portion of the windlass spool 116* (as shown in FIG. 25) and then is fed back into the open cavity 130* and upwardly through the entry port 140* out of the windlass housing 118* and is secured to the head rail 14'. The windlass spool 116* is then installed in the windlass housing 118* by pushing the windlass spool 116* upwardly into the open cavity 130* through the bottom of the windlass housing 118*. The stub shafts 148*, 150* (See FIGS. 23 and 26) of the windlass spool 116* slide up the ramps 136*, 138* and push outwardly against the arms 132*, 134*, gradually prying them apart as the windlass spool moves upwardly until the windlass spool 116* clears the tops of the arms 132*, 134*, at which point the arms 132*, 134* snap back to their original positions, securing the windlass spool 116* in the housing 118* as shown in FIGS. 21, 22 and 26. The second end of the lift cord 108* is then extended through the covering 18* and is secured to the respective lift station 20* in the bottom rail 16*.

The connecting rod 23* is inserted through both windlass assemblies 112* and through the splined sleeve 32* of the locking mechanism 12*, as shown in FIG. 19.

As was discussed with respect to the locking mechanism 12 of FIGS. 3-5, when the user squeezes the slide tab 70* and fixed tab 42* together, the wing that is fixed to the slide tab 70* moves away from the splined portion of the splined sleeve 32*, unlocking the locking mechanism 12* and allowing rotation of the connecting rod 23* and associated windlass spools 116*.

The Operation of the Shade 10* is as Follows:

To raise the bottom rail 16*, the user grabs the bottom rail 16* (See FIG. 20) and lifts it up. The spring motor with drag brake 24* located in the bottom rail 16* assists in raising the bottom rail 16*. The spring motor 24* causes rotation of the spools in the lift stations 20* in order to wind up any excess lift cord 108* onto the spools as the bottom rail 16* is raised. When the user releases the bottom rail 16*, the drag brake portion of the spring motor with drag brake 24* holds the bottom rail 16* in place. Since the spools in the lift stations 20* rotate together, they keep the bottom rail 16* horizontal as it travels up and down.

To lower the bottom rail 16*, the user pulls down on the bottom rail 16*. The lift cords 108* are attached to the head rail 14*, are cinched tightly around their respective windlasses (or capstans) 116*, and extend to the spools on the lift stations 20* in the bottom rail 16*. Since the locking mechanism 12* has not been released, the connecting rod 23* is locked against rotation, as are the windlass spools 116*, so the intermediate rail 15* remains stationary. The lift cords 108* unwind from the lift stations 20* in the bottom rail 16*, and the bottom rail 16* is lowered. Again, once the user releases the bottom rail 16*, the drag brake portion of the spring motor with drag brake 24* holds the bottom rail 16* in position.

To raise the intermediate rail 15*, the user squeezes the tabs 42*, 70* together, which releases the splined sleeve 32* for rotation. Since the connecting rod 23* and the windlass spools 116* are keyed to the splined sleeve 32*, they also can rotate. If the user lifts up on the intermediate rail 15* while squeezing the tabs 42*, 70* together, the windlass spools 116* will rotate in their respective windlass housings 118*, travelling upwardly along the lift cord 108* as they transfer a portion of the lift cord 108* that is above the windlass assemblies 112* to below the windlass assemblies 112*, so the intermediate rail 15* also travels upwardly along the cords 108*. Once the intermediate rail 15* is in the desired location, the user releases the tabs 42*, 70* of the locking mechanism 12*, which locks the splined sleeve 32*, and therefore the connecting rod 23* and the windlass assemblies 112*, against further rotation, thereby locking the intermediate rail 15* in place.

To lower the intermediate rail 15*, the procedure is the reverse of that for raising the intermediate rail 15* described above. The user squeezes together the tabs 42*, 70* of the locking mechanism 12*, which releases the splined sleeve 32* for rotation, which allows the connecting rod 23* and the windlass assemblies 112* to rotate. While squeezing together the tabs 42*, 70*, the user pulls down on the intermediate rail 15*. The windlass spools 116* rotate in the opposite direction, and the intermediate rail 15* travels downwardly along the lift cords 108*. Once the intermediate rail 15* is in the desired position, the user releases the tabs 42*, 70* of the locking mechanism 12*, which locks the intermediate rail 15* in place. Since the windlass spools (or capstans) 116* are tied together by the rod 23* and rotate together, they keep the intermediate rail 15* horizontal as it travels up and down.

It should be noted that the bottom rail 16* remains in position as the intermediate rail 15* is raised and lowered, since the position of the bottom rail 16* is determined by the rotation of the spools on the lift stations 20*, not by the position of the intermediate rail 15*.

The tapered surfaces 152*, 154* on the windlass spools 116* ensure that the lift cords 108* remain centered on the windlass spools 116*, and the ribs 145* on the windlass spools 116* together with the biasing leg 144* which presses the lift cord 108* against the ribs 145* ensures that the cord 108* does not slip relative to the windlass spools 116*, so the cord 108* serves as a type of indexing mechanism which automatically rotates the rod 23* as the rail 15* is raised and lowered without requiring a motor. This helps ensure that the intermediate rail 15* remains horizontal as it travels up and down along the lift cords 108*.

Alternate Embodiment of a Windlass

FIGS. 27-31 show an alternate embodiment of a windlass assembly 112 which may be used in the cellular shade of FIGS. 18-20 instead of the windlass assembly 112*. As best appreciated in FIG. 28, the windlass assembly 112** includes a windlass spool (or capstan) 116**, a windlass housing 118**, and a windlass housing cover 119****.

The most important difference between this windlass assembly 112 and the windlass assembly 112* described above is that this windlass assembly 112** does not have a biasing member 144*. Instead, and as best appreciated in FIGS. 28, 29, 30 and 31, the windlass housing 118** and the windlass housing cover 119** each have semi-circular surfaces 156**, 158** which define circumferential guiding grooves 160**, 162** respectively, which tightly guide the lift cord 108* around the windlass spool 116**, pressing the lift cord 108* against the ribs 145** (See FIGS. 28 and 31) of the windlass spool 116** to prevent slippage between the lift cord 108* and the windlass spool 116**, that is, to prevent the possibility of the lift cord 108* surging the windlass spool 116****.

The operation of the cellular shade 18 using this second embodiment of a windlass assembly 112 is identical to the operation described earlier with respect to the first embodiment of the windlass assembly 112***.

Alternate Embodiment of a Cellular Shade with a Drive with a Lock Mechanism

FIGS. 32-38 depict an embodiment of a cellular shade 10', similar to the shade 10 of FIG. 1, except that an indexing mechanism 164' is used to automatically rotate the lift rod 22 as the movable rail 16' is raised and lowered without requiring a spring motor. (It should be noted that a windlass 172B and cord 168B could be substituted as an alternative indexing mechanism, as shown in FIG. 34B.)

Figure 32:
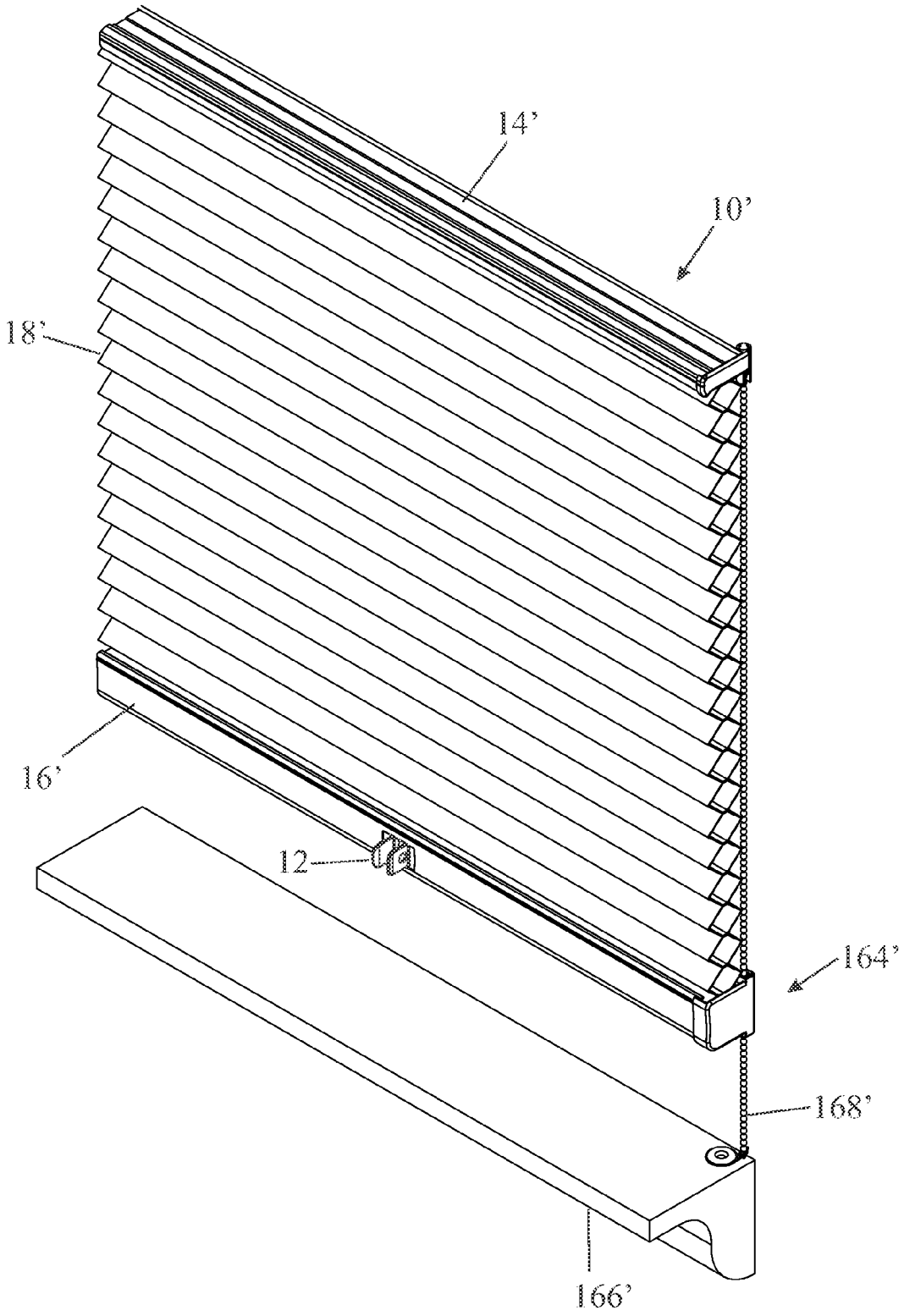
FIG. 32 is a front perspective view of a cellular shade, similar to that of FIG. 1, but with a different drive mechanism.
Figure 33:
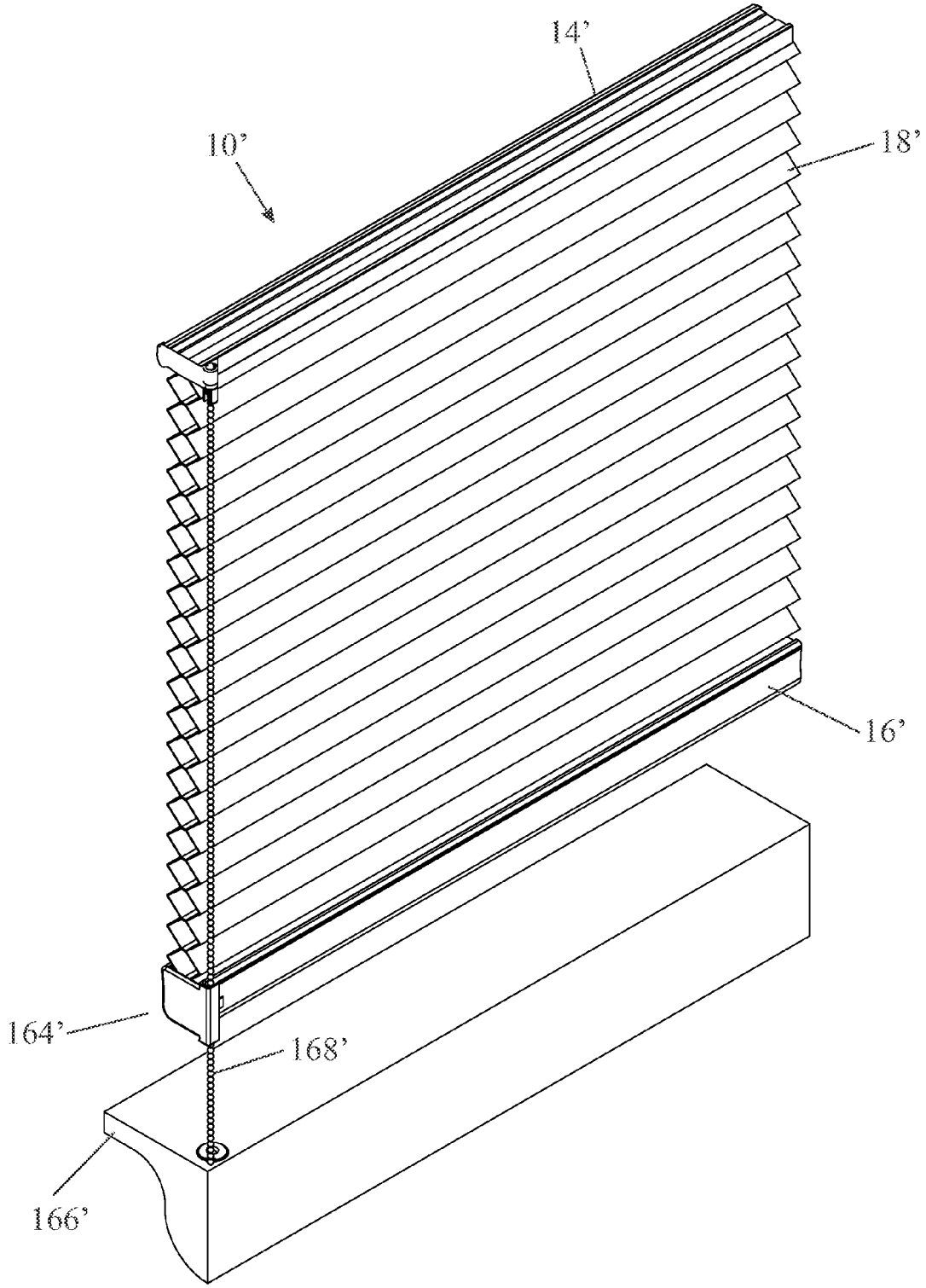
FIG. 33 is a rear perspective view of the cellular shade of FIG. 32.
Figure 34:
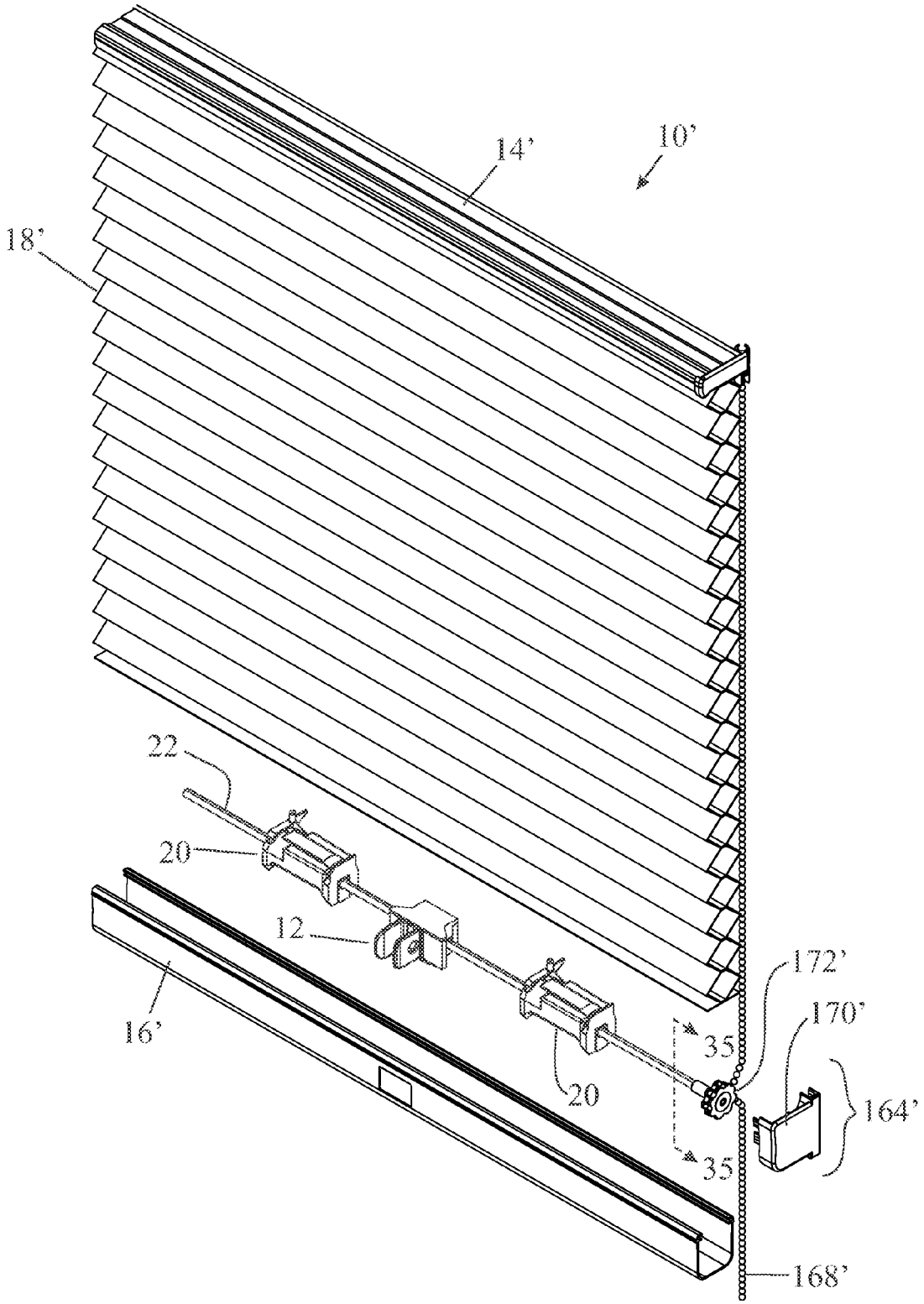
FIG. 34 is a partially exploded perspective view of the cellular shade of FIG. 32.

FIGS. 32, 33, and 34 show the cellular shade 10' which includes a top rail 14', bottom horizontal movable rail 16', a cellular shade structure 18', and an anchoring ledge 166'. It should be noted that the anchoring ledge 166' may be part of the frame of the window opening and serves the purpose of providing an anchoring point to secure a bead chain 168' which extends from the top rail 14' to the anchoring ledge 166'.

As shown in FIG. 34, the bottom rail 16' houses a slide lock mechanism 12, lift stations 20, and a lift rod 22, which are identical to the corresponding items in the cellular shade 10 of FIG. 3. The most important difference is the absence of the spring motor 24 (See FIG. 3) which has been replaced by the indexing mechanism 164' (See FIG. 34), as explained in more detail below.

Referring to FIGS. 35-38, the indexing mechanism 164' includes a bottom rail end cap 170' and a sprocket 172', and utilizes the bead chain 168' to rotate the lift rod 22 when the bottom rail 16' is raised or lowered, as explained later. The sprocket 172' and lift rod 22 cause the lift spools 20 to rotate together, which keeps the rail 16' horizontal as it travels up and down.

Figure 35:
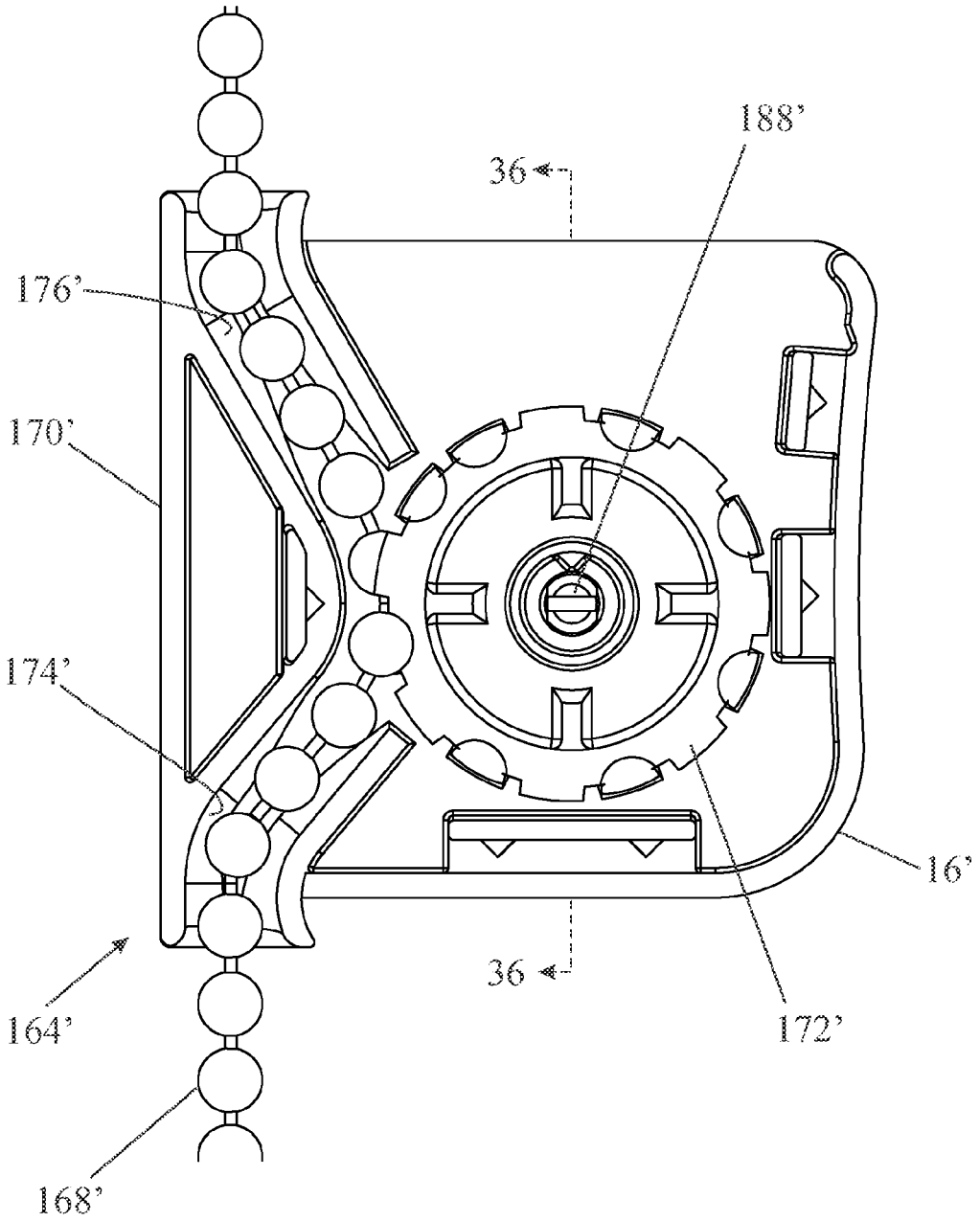
FIG. 35 is a section view along line 35-35 of FIG. 34, but with the sprocket mounted onto the end cap.
Figure 36:
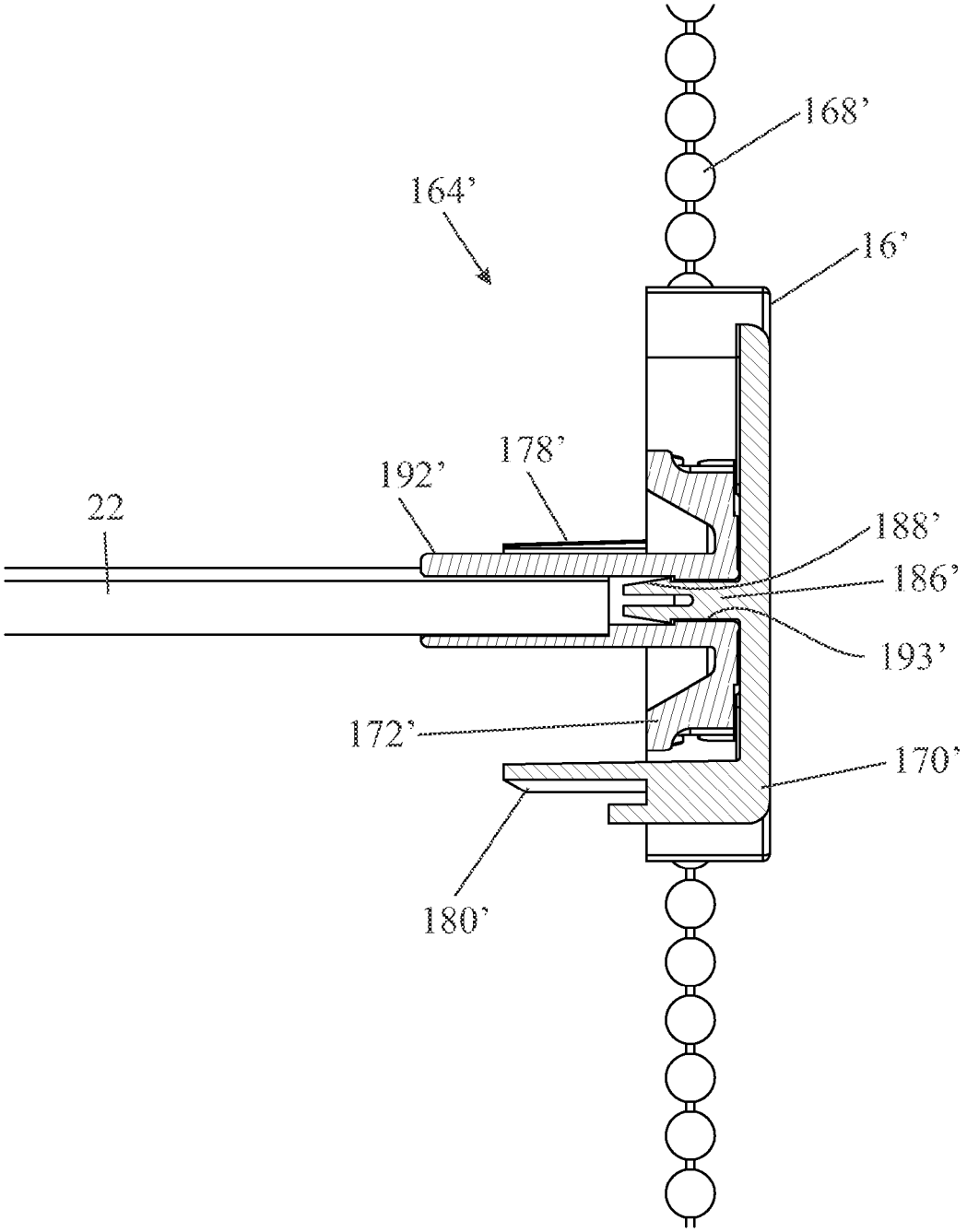
FIG. 36 is a section view along line 36-36 of FIG. 35.
Figure 37:
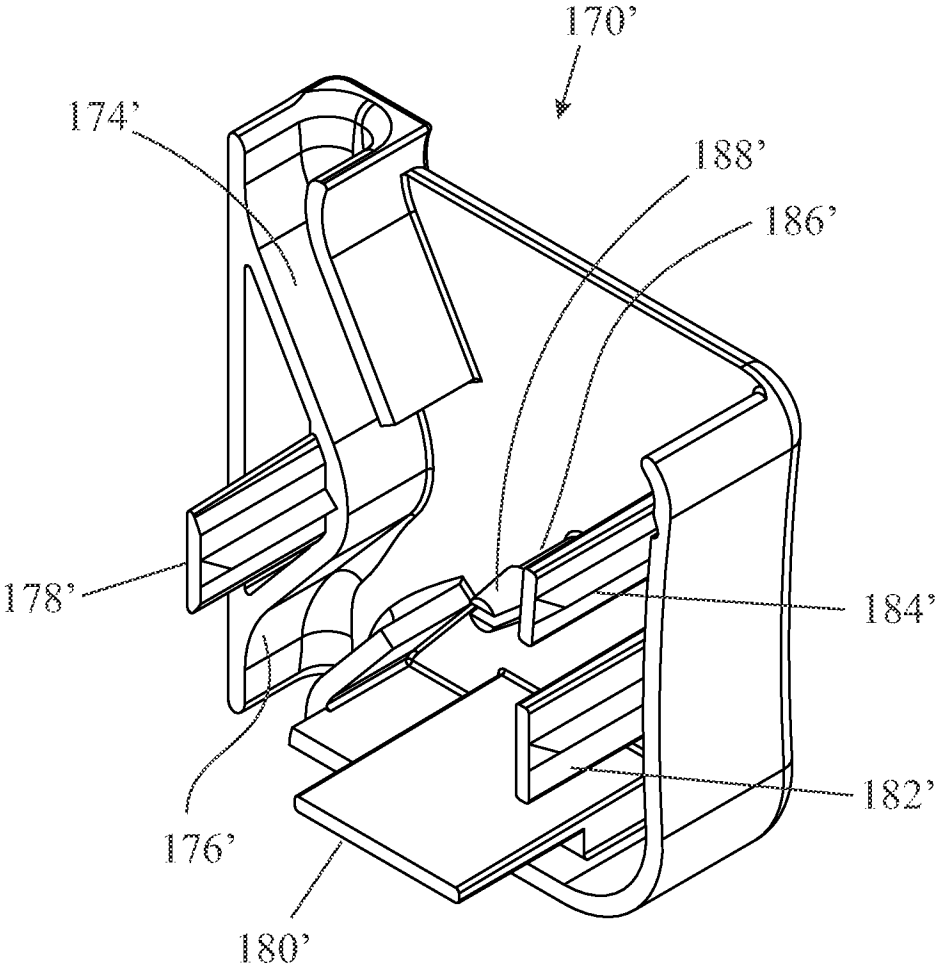
FIG. 37 is a perspective view of the end cap of FIG. 34.

Referring to FIG. 37, the bottom rail end cap 170' defines ramped approaches 174', 176' to guide the bead chain 168' to the sprocket 172', as may also be appreciated in FIG. 35. The end cap 170' also includes flat projections 178', 180', 182', and 184' which project inwardly from the end cap 170' and which are used to releasably secure the end cap 170' to the bottom rail 16'. Finally, the end cap 170' also includes a support shaft 186' with an enlarged diameter, barbed end 188'. The support shaft 186' rotationally supports the sprocket 172', as shown in FIG. 36.

Figure 38:
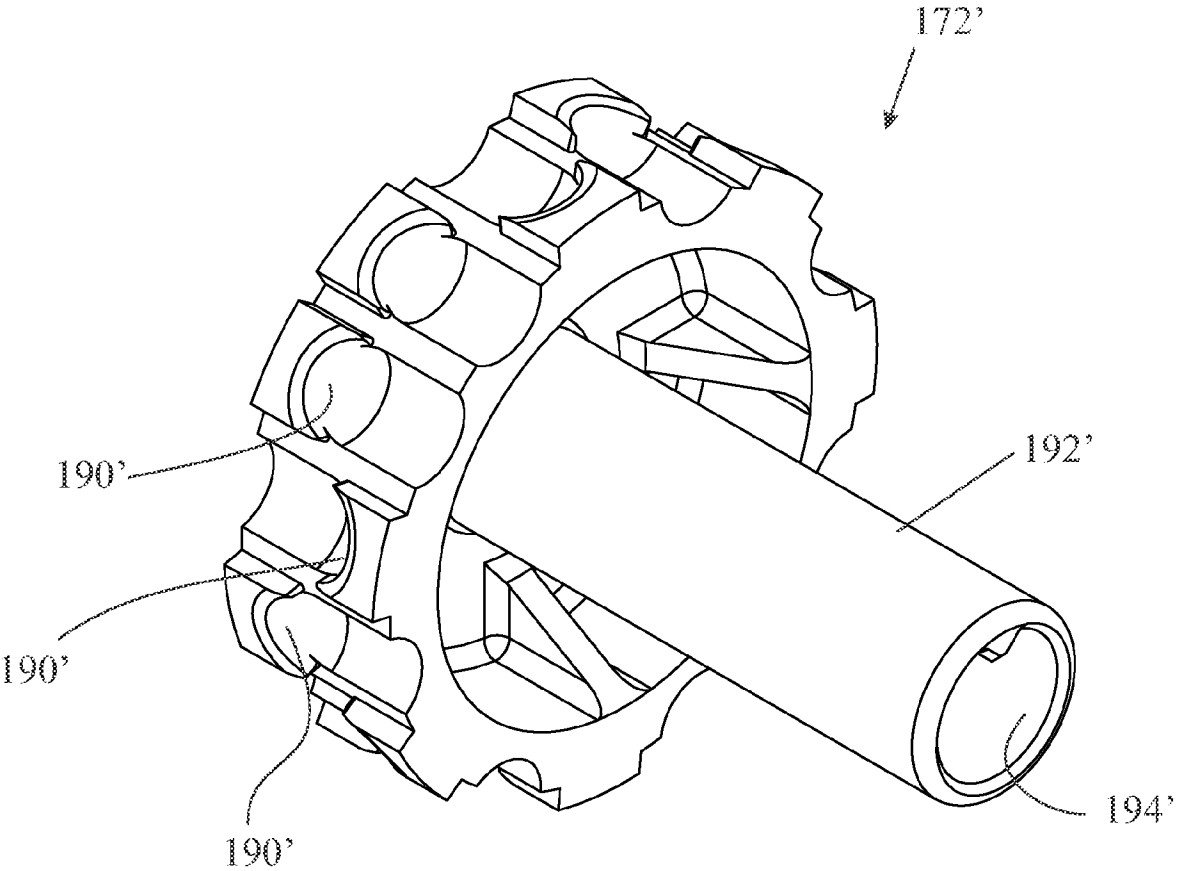
FIG. 38 is a perspective view of the sprocket of FIG. 34.

FIG. 38 shows the sprocket 172' which includes a plurality of semi-circular, circumferentially-arranged, evenly-spaced and alternatingly-opposed cavities 190' designed to receive and engage the beads of the bead chain 168' as the indexing mechanism 164' is raised or lowered together with the bottom rail 16'. The hollow shaft 192' of the sprocket 172' has a non-cylindrical cross-sectional profile 194' which matches up with a similarly shaped cross-sectional profile on the lift rod 22 for positive rotational engagement between the sprocket 172' and the lift rod 22. The portion of the hollow shaft 192' that is located inside the sprocket "teeth"

190' has a reduced inside diameter portion 193' (See FIG. 36), which helps retain the sprocket 172' onto the shaft 186' as describe below.

To assemble the indexing mechanism 164' to the shade 10', the sprocket 172' is first rotationally mounted to the shaft 186' on the end cap 170' by pushing the sprocket 172' onto the shaft 186' and compressing the barbed end 188' until the reduced diameter portion 193' of the sprocket 172' passes the barbed end 188', at which point the barbed end 188' snaps open to its non-compressed position, locking the sprocket 172' onto the shaft 186', as shown in FIG. 36. Then, one end of the bead chain 168' is fed through the ramped approach 174' (See FIG. 37) and the sprocket 172' is manually rotated to feed the bead chain 168' around the sprocket 172', with the beads on the bead chain 168' engaging the cavities 190' on the sprocket 172'. The bead chain 168' wraps around the sprocket 172' and then exits the end cap 170' via the ramped approach 176'. The indexing mechanism 164' is then pressed onto the end of the bottom rail 16', with the lift rod 22 being inserted into and engaging the non-cylindrical cross-sectional profile 194' of the shaft 192' of the sprocket 172'. The end of the bead chain 168' is then secured to the anchoring ledge 166' such that the bead chain 168' is fairly taut between the top rail 14' and the anchoring ledge 166'.

Operation:

To raise the shade 10' the lock 12 is unlocked, as explained earlier with respect to the embodiment described in FIGS. 1-3, and the operator manually raises the bottom rail 16' to the desired height. As the bottom rail 16' is raised, the bead chain 168' rotates the sprocket 172' in a first direction, which also rotates the lift rod 22 and the lift stations 20, so as to gather up the lift cords (not shown) onto the spools of the lift stations 20 in the movable rail 16'. When the operator releases (lets go of) the lock mechanism 12, it locks the lift rod 22 against further rotation, holding the bottom rail 16' where it was released, as described earlier with respect to the shade 10 of FIGS. 1-3.

To lower the shade 10', the operator again unlocks the lock 12 and lowers the bottom rail 16' to the desired position. As the bottom rail 16' is lowered, the bead chain 168' rotates the sprocket 172' in the opposite direction which then also rotates the lift rod 22 and the lift stations 20 in the opposite direction, unwinding the lift cords (not shown) from the spools of the lift stations 20. When the operator releases (lets go of) the lock mechanism 12, it locks the lift rod 22 against further rotation, holding the bottom rail 16' where it was released.

Figure 34A:
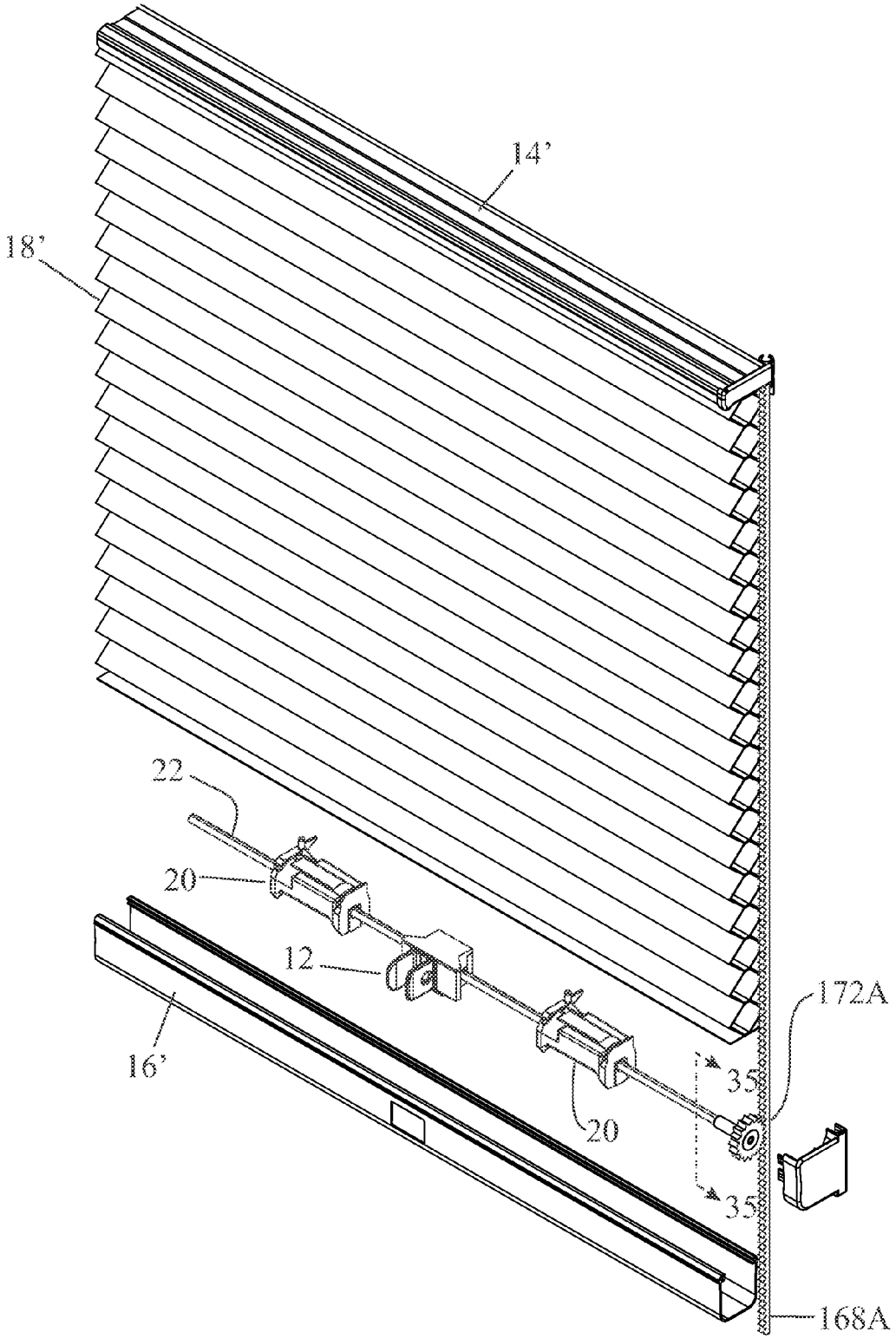
FIG. 34A is a view similar to FIG. 34, but using a rack and pinion arrangement instead of a bead chain.
Figure 34B:
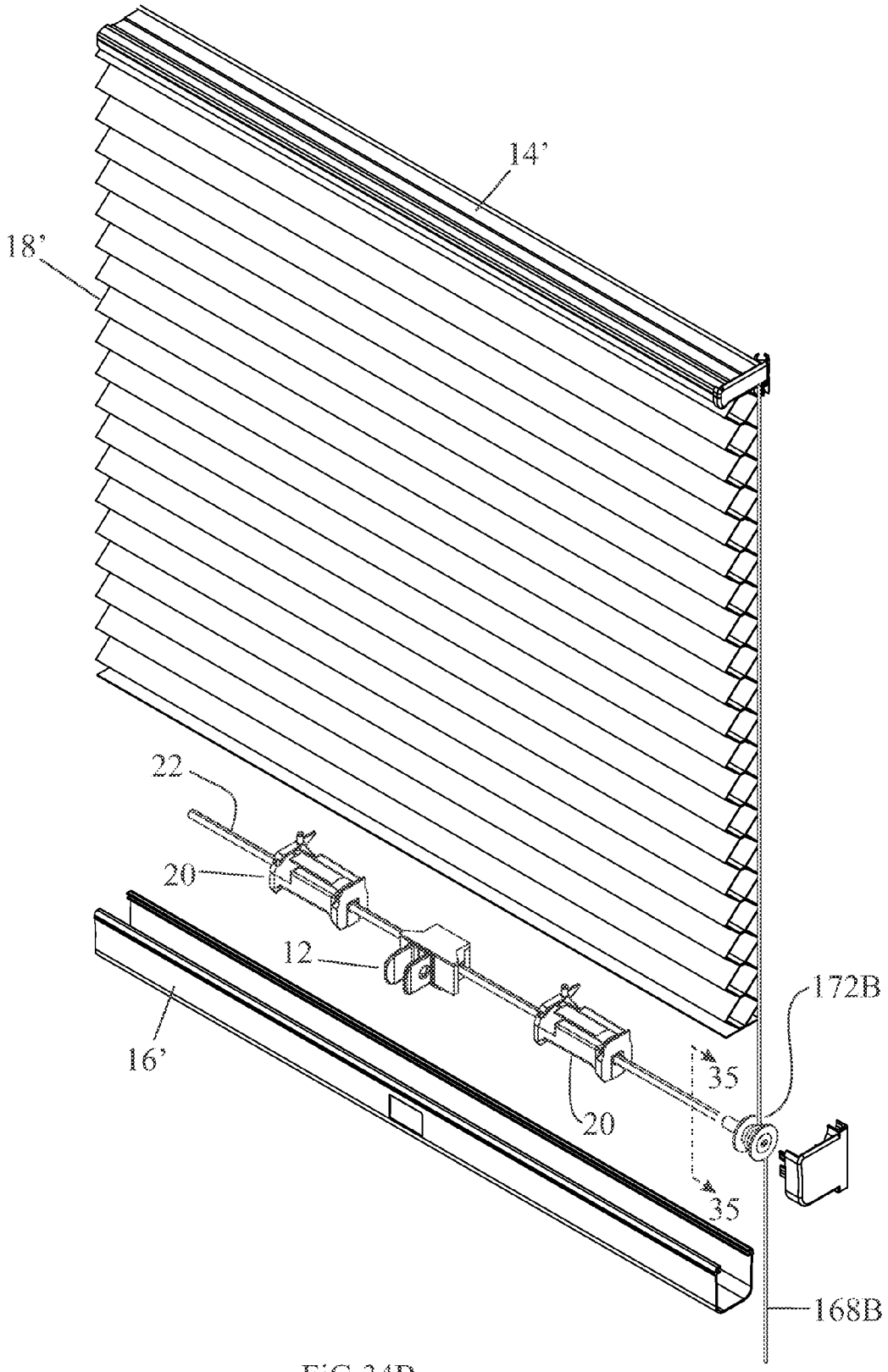
FIG. 34B is a view similar to FIG. 34, but using a cord and windlass instead of a bead chain.
Figure 39:
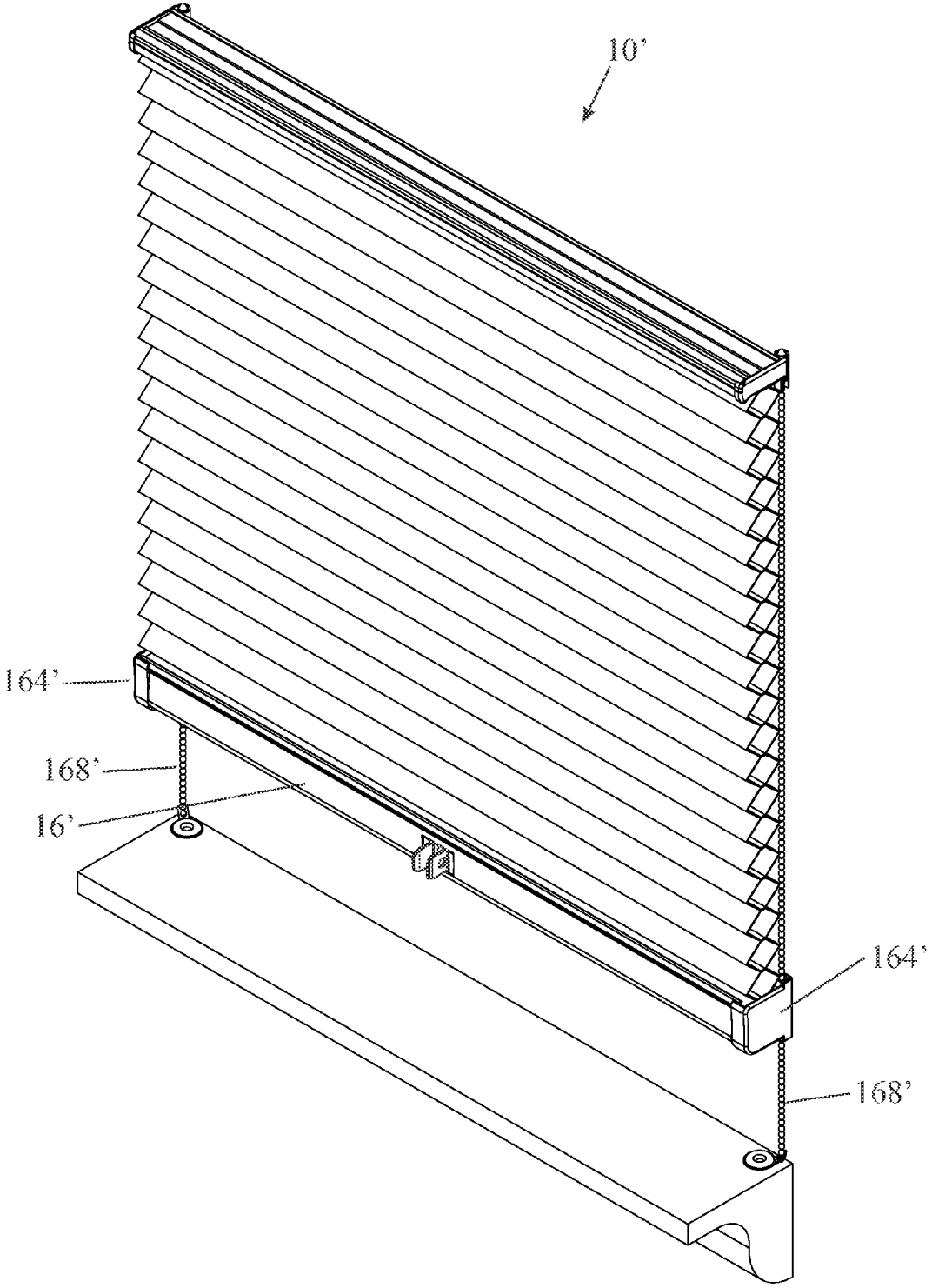
FIG. 39 is a perspective view of a cellular shade, similar to that of FIG. 32, but with index drive mechanisms at both ends of the shade.

FIG. 39 shows yet another embodiment of a cellular shade 10" which is very similar to the shade 10' described above, except that it has two indexing mechanisms 164', one on each end of the bottom rail 16', which ride along their corresponding bead chains 168'. Other than this difference, the shade 10" is identical to the shade 10' and operates in the same manner. It should be obvious that other indexing mechanisms may be used instead of the bead chain and sprocket mechanism shown in the figures. For instance, as shown in FIG. 34A, a rack and pinion arrangement may be used in which the rack 168A replaces the bead chain and the pinion 172A replaces the sprocket. Any indexing mechanism that is used to automatically rotate the lift rod as the movable rail is raised and lowered without requiring a motor may be used to replace the bead chain and sprocket mechanism described above.

Two Movable Rail Shade with Automatic Variable Stroke Limiter

While the embodiment shown in FIGS. 18-20 is one way to arrange for raising and lowering two (or more) movable rails without the addition of a second set of lift cords 110' as in FIG. 16, another way to achieve this result is shown in FIGS. 40-44.

FIGS. 40-44 are schematics of a shade 200 with two movable rails in which the upper rail is suspended by lift cords that extend to fixed points above the upper rail, and the lower rail is suspended by lift cords that extend down from the upper rail.

With this type of arrangement, the issue arises that if the lower rail lift cords are long enough so the lower movable rail can extend to the bottom of the architectural opening when the upper rail is at the top of the opening, then the lower movable rail may extend below the bottom of the architectural opening when the upper rail moves down. Of course, this is not desirable. For that reason, an automatic variable stroke limiter has been incorporated into this design.

As explained in more detail later, the automatic variable stroke limiter controls the overall length of the shade 200 so that the bottom rail will not extend beyond a desired position, such as beyond the bottom of the opening, regardless of the position of the upper movable rail.

Figure 40:
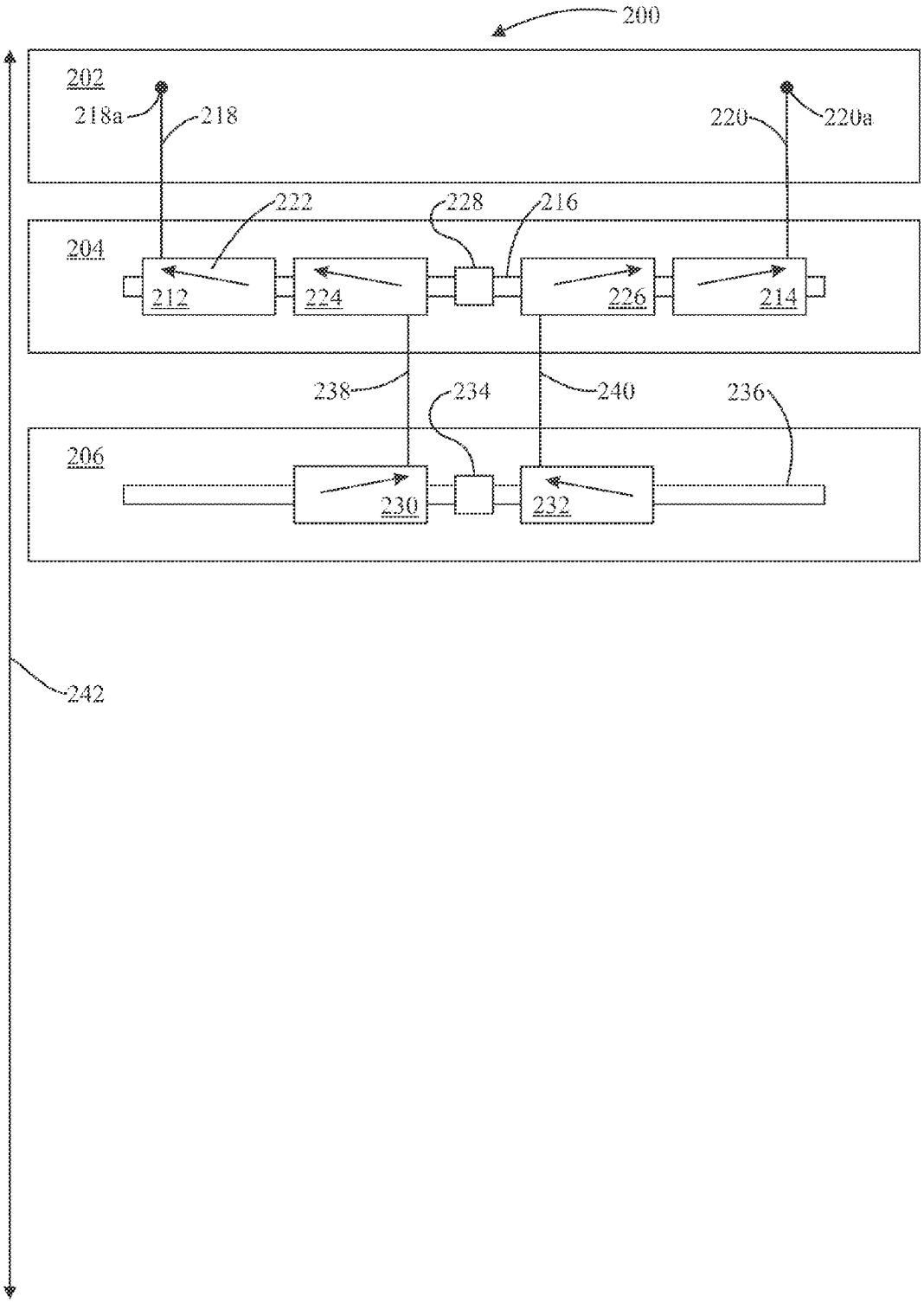
FIG. 40 is a schematic of a top down/bottom up shade with an automatic variable stroke limiter, with both movable rails in their retracted positions.

Referring to FIG. 40, the shade 200 includes a head rail 202, an upper movable rail 204, and a lower movable rail 206. Extendable covering materials 208 (See FIG. 44) such as a pleated shade material or a plurality of slats supported by ladder tapes may be secured to the upper and lower rails 204, 206, so that, when the rails move up and down, they extend and retract the covering materials. For example, in FIG. 44, the covering material 208 extends between the upper movable rail 204 and the lower movable rail 206. As another possibility, a first covering material 208 could extend from the head rail 202 to the upper movable rail 204, and a second covering material 208 could extend from the lower movable rail 204 to the bottom of the architectural opening.

The upper movable rail 204 houses first and second cord spools 212, 214 mounted for rotation together on an elongated upper rail lift rod 216. The cord spools 212, 214 may be located anywhere along the upper rail lift rod that is desired. For example, if a pleated shade material is extending between the head rail 202 and the upper movable rail 204, the cord spools 212, 214 will be located inwardly far enough to ensure that the pleated shade material remains under control and does not "blow out". If no covering material is extending between the head rail 202 and the upper movable rail 204, then it may be desirable to move the cord spools 212, 214 further outwardly so the cords that wrap around them do not interfere with the user's line of sight.

First and second upper rail lift cords 218, 220 have their first ends secured to the head rail 202 at fixed points 218*a*, 220*a* and their second ends secured to the cord spools 212, 214. As an alternative, the head rail 202 may be omitted and the first set of lift cords may be secured directly to the frame of the window opening at the fixed points 218*a*, 220*a*. It also should be noted that the fixed points 218*a*, 220*a* may alternatively be points on a movable rail located above the upper movable rail.

In these schematics, the angled arrows on the cord spools (such as the arrow 222 on the cord spool 212 in FIG. 40) indicate the extent to which the lift cord is wrapped onto the cord spool. If the lift cord is shown coming off of the respective spool at the end near the tip of the arrow, that means it is fully wound onto that spool. If it is shown coming off the respective spool at the opposite end, that means it is unwound from that spool.

Figure 41:
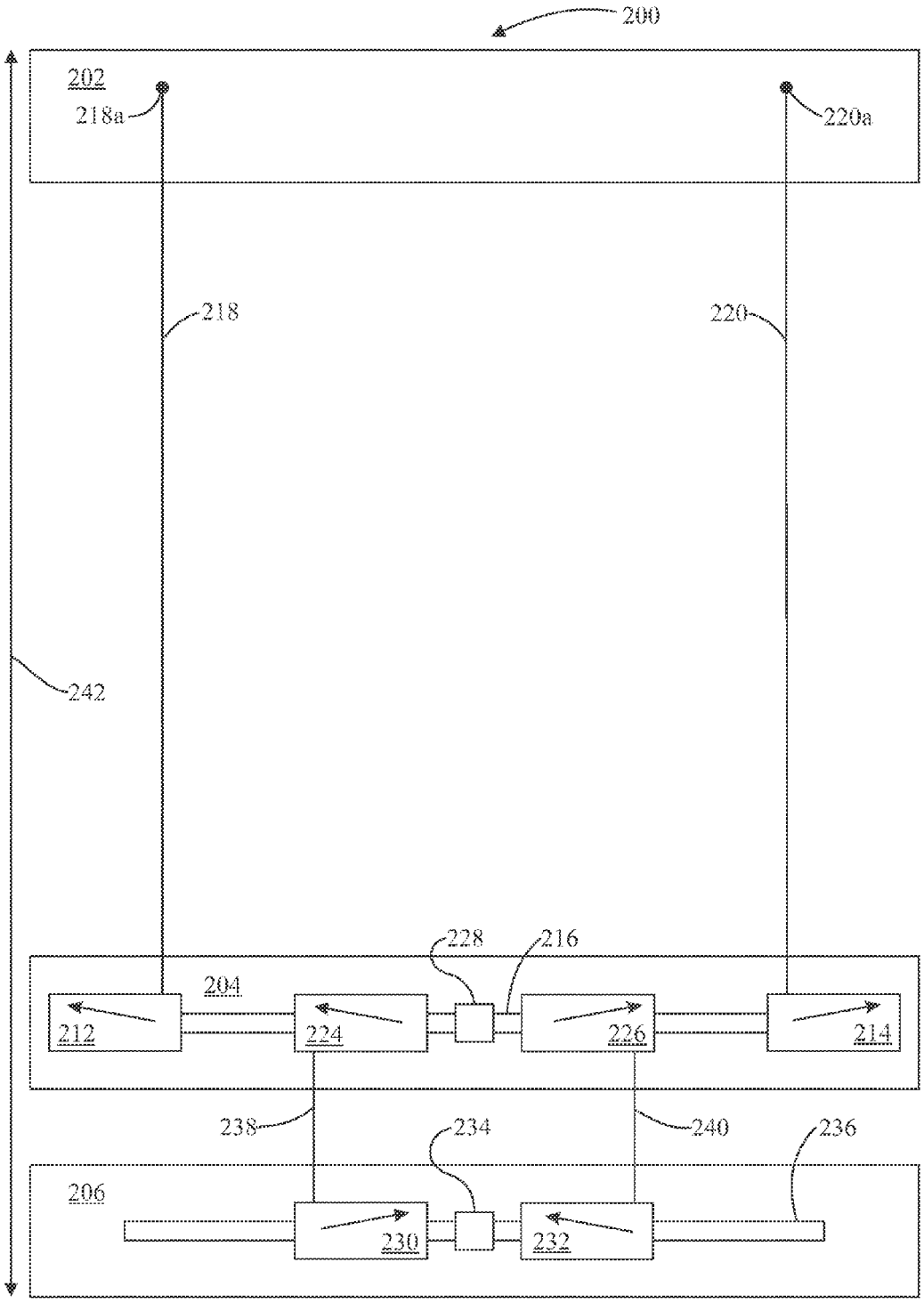
FIG. 41 is a schematic of the shade of FIG. 40 with the upper movable rail in its fully extended position and the lower movable rail in its fully retracted position.
Figure 42:
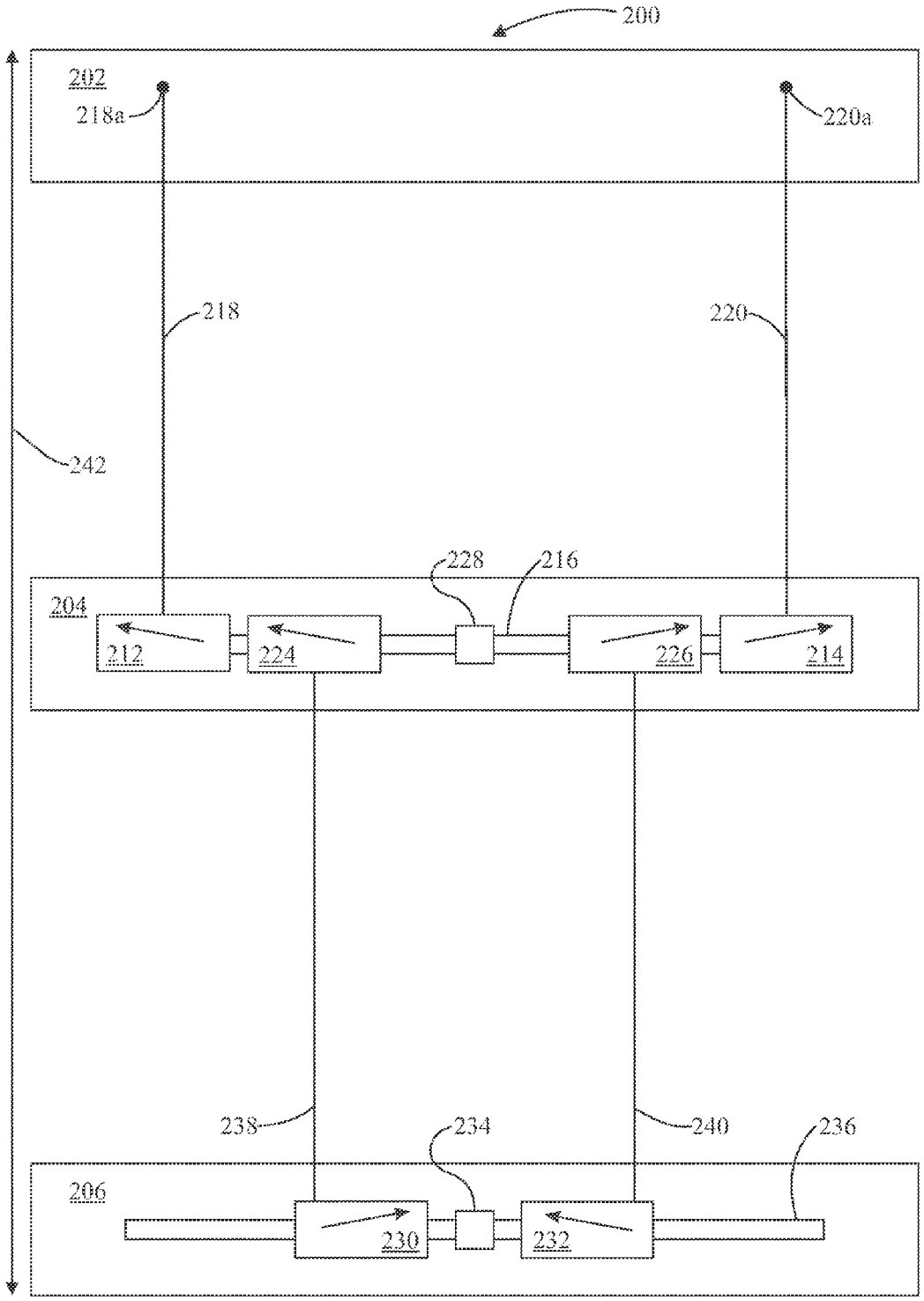
FIG. 42 is a schematic of the shade of FIG. 40 with the upper movable rail in a partially extended position and the lower movable rail in a partially extended position.

For example, in FIG. 40, the lift cord 218 is fully wrapped onto the cord spool 212, while in FIG. 41 the same lift cord 218 is fully unwrapped from the cord spool 212, and in FIG. 42 the same lift cord 218 is approximately half way wound onto the cord spool 212.

Referring again to FIG. 40, two counterwrap cord spools 224, 226 are mounted on the same upper rail lift rod 216, between the first and second cord spools 212, 214, for rotation together with the lift rod 216. These counterwrap cord spools 224, 226 may be located anywhere along the lift rod 216, as desired. Lower rail lift cords 238, 240 are counterwrapped onto these additional cord spools 224, 226 (wrapped in the direction opposite to the direction of the wrap on the first and second cord spools 212, 214) so that, as the upper lift rod 216 rotates to wind up the upper rail lift cords 218, 220 onto the first and second lift spools 212, 214, it causes the lower rail lift cords 238, 240 to unwind from their respective counterwrap spools 224, 226. Similarly, as the upper rail lift rod 216 rotates in the opposite direction, to unwind the upper rail lift cords 218, 220 from their lift spools 212, 214, it causes the counterwrapped lower rail lift cords 238, 240 to wrap onto the counterwrap spools 224, 226.

It should be noted that, while the lift spools 212, 214 and counterwrap spools 224, 226 are shown as separate pieces mounted on the upper lift rod 216 and individually movable along that lift rod 216, it would be possible for two (or even more) of the cord spools to be made as a single piece. Also, while the first and second upper rail lift cords 218, 220 are shown in this schematic as being separate from the first and second counterwrap cords 238, 240, it is understood that the first upper rail lift cord 218 and the first counterwrap cord 238 could actually be a single cord, and, similarly that the second upper rail lift cord 220 and the second counterwrap cord 240 could be a single cord.

A motor 228, such as the spring motor 24 of FIG. 3, also is mounted on the upper rail lift rod 216 to assist in wrapping the lift cords 218, 220 onto their respective cord spools 212, 214 when raising the upper movable rail 204. (The motor 228 could alternatively be a battery-powered electric motor.)

The shade 200 also includes a lower movable rail 206 which houses two cord spools 230, 232 mounted on a lower rail lift rod 236 for rotation together with the rod 236. As with the previous cord spools, these lower rail cord spools 230, 232 may be located anywhere along the lower rail lift rod 236. The two lower rail lift cords 238, 240 have their first ends secured to the counterwrap cord spools 224, 226, respectively, and their corresponding second ends secured to the corresponding cord spools 230, 232 on the lower movable rail 206. The vertical line 242 shown on the left side of FIGS. 40-43 represents the full length of the window opening on which the shade 200 is installed.

Referring to FIG. 40, the shade 200 is shown with both the upper movable rail 204 and the lower movable rail 206 in the fully retracted positions. That is, the upper movable rail 204 is all the way up against the head rail 202, and the lower movable rail 206 is all the way up against the upper movable rail 204. When the rails are in this position, the first and second upper rail lift cords 218, 220 are fully wrapped onto their respective first and second cord spools 212, 214. The lower rail lift cords 238, 240 are fully wrapped onto their respective lower rail cord spools 230, 232 and fully unwrapped from their respective counterwrap cord spools 224, 226.

The user now may lower the upper rail until it is fully extended, while the lower movable rail 206 remains all the way up against the upper movable rail 204, as shown in FIG. 41. In this instance, as the upper movable rail 204 is lowered, the first and second upper rail lift cords 218, 220 unwrap from their corresponding first and second cord spools 212, 214 and, as they do so, they cause the upper rail lift rod 216 to rotate, which causes the counterwrap cord spools 224, 226 to rotate, which causes the lower rail lift cords 238, 240 to wrap onto the counterwrap cord spools 224, 226. Since the lower rail 206 already is abutting the upper rail 204 and therefore cannot move up any further relative to the upper rail 204, as the user pulls down on the upper movable rail 204, he is also pushing down on the abutting lower movable rail 206, so the lower rail lift cords 238, 240 unwrap from the lower rail cord spools 230, 232 as they wrap onto the counterwrap cord spools 224, 226.

In FIG. 41, the upper movable rail 204 is in the fully extended position, with the upper rail lift cords 218, 220 fully unwound from their spools 212, 214. The lower movable rail 206 is abutting the upper movable rail 204, with the lower rail lift cords 238, 240 fully wound onto the counterwrap spools 224, 226 and fully unwound from the lower rail spools 230, 232. The total length of the shade 200 matches the length of the opening (depicted by the arrow 242), so the lower movable rail 206 is at the bottom of the architectural opening. The lower movable rail 206 cannot be lowered any further relative to the upper movable rail 204 because the lower rail lift cords 238, 240 are already fully unwrapped from the lower rail cord spools 230, 232.

It might be suggested that the lower rail lift cords 238, 240 could unwrap from the counterwrap cord spools 224, 226 to further lower the lower movable rail 206. However, in order to unwrap the lower rail lift cords 238, 240 from the counterwrap cord spools 224, 226 the counterwrap spools 224, 226 would have to rotate together with the upper rail lift rod 216 and the first and second cord spools 212, 214, which would wind the upper rail lift cords 218, 220 onto the first and second cord spools 212, 214 to raise the upper rail 204. Thus, rotating the upper lift rod 216 to extend the lower rail lift cords 238, 240 would also retract the upper rail lift cords 218, 220 by the same distance, such that the lower movable rail 206 would remain stationary relative to the head rail 202; it would not drop below the length of the opening (depicted by the arrow 242).

Referring now to FIG. 42, the user has raised the upper movable rail 204 to an intermediate position approximately half way between the fully retracted position (shown in FIG. 40) and the fully extended position (shown in FIG. 41). The upper rail lift cords 218, 220 are approximately half way wrapped onto their corresponding first and second cord spools 212, 214. The lower rail lift cords 238, 240 are approximately half way unwrapped from the counterwrap cord spools 224, 226 on the upper movable rail 204 and are fully unwrapped from the lower rail cord spools 230, 232. Again, the lower movable rail 206 cannot be lowered any farther than the bottom of the opening 242. The lower rail cord spools 230, 232 already are fully unwrapped. Therefore, any lengthening of the lower rail extension cords 238, 240 would have to come from their unwrapping from the counterwrap cord spools 224, 226. However, these counterwrap cord spools 224, 226 are tied to the first and second cord spools 212, 214 by the upper rail lift rod 216, so any unwrapping of the lower rail lift cords 238, 240 from the counterwrap cord spools 224, 226 would only occur along with corresponding wrapping of the upper rail lift cords 218, 220 onto their corresponding first and second cord spools 212, 214, thus shortening these upper rail lift cords 218, 220 by the same distance the lower rail lift cords 238, 240 are lengthened. Thus, while the lower movable rail 206 would move some distance away from the upper movable rail 204, the upper movable rail 204 would be moving the same distance toward the head rail 202, resulting in the lower movable rail 206 remaining in the same position relative to the fixed points 218*a*, 220*a*.

Figure 43:
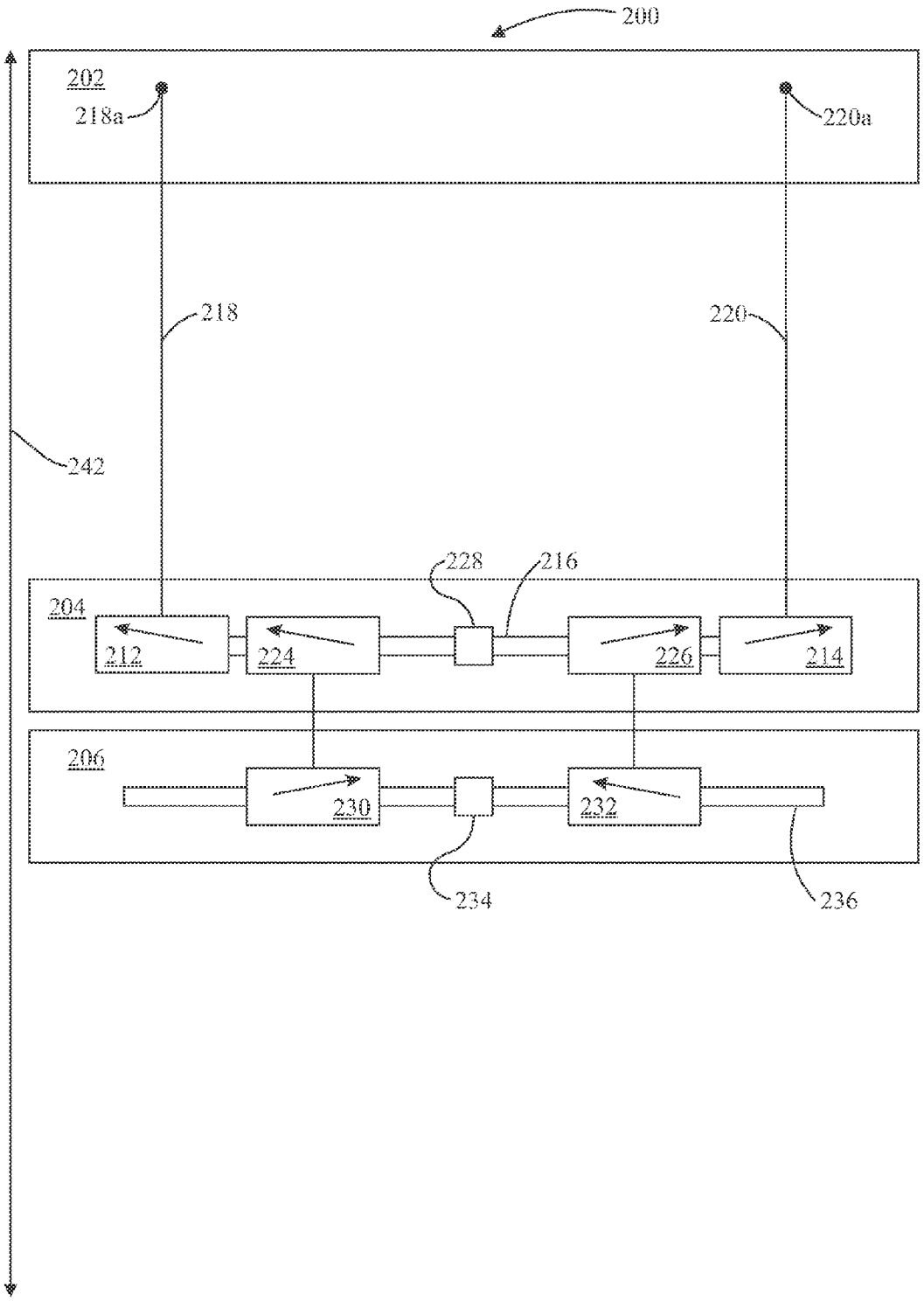
FIG. 43 is a schematic of the shade of FIG. 40 with the upper movable rail in a partially extended position and the lower movable rail in its fully retracted position.

Comparing FIGS. 42 and 43, it may be appreciated that in both figures the lower rail lift cords 238, 240 are wrapped halfway onto the counterwrap cord spools 224, 226. In FIG. 42, the lower rail lift cords are fully unwrapped from the lower rail spools 230, 232, so the balance of the lower rail lift cords 238, 240 spans the distance between the upper movable rail 204 and the lower movable rail 206. When the lower movable rail 206 is raised to the position shown in FIG. 43, where it abuts the upper movable rail 204, the counterwrap cord spools 224, 226 do not move, so no more cord is wrapped onto them. All the excess of the lower rail lift cords 238, 240 resulting from the raising of the lower movable rail 206 wraps onto the lower rail cord spools 230, 232, which, in FIG. 43, are shown to be half-way wrapped with the lower rail lift cords 238, 240.

In this embodiment, the motors 228, 234 provide at least enough force to wrap any excess cords onto their respective spools as the movable rails are raised. The motors 228, 234 may also provide additional force to aid the user in lifting the movable rails so as to reduce the catalytic force required from the user to raise the movable rails. In this embodiment, the forces acting to raise the shade 200 (essentially the force provided by the motors 228, 234) are close enough to forces acting to lower the shade 200 (essentially the force of gravity acting on the components) that the friction and inertia in the system are sufficient to prevent the rail from moving up or down once the rail is released by the user.

As an alternative embodiment, the number 228, which represents a motor in the upper movable rail 204, could instead represent a lock that is operable by the user, such as the lock 12 shown in FIG. 1. In that case, if the user begins with the shade 200 in the position shown in FIG. 42, when the user releases the lock in the upper movable rail 204 and raises the upper movable rail from the position shown in FIG. 41, the lower rail lift cords 238, 240 will pull on the counterwrap spools 224, 226 and cause them to unwind, which will act as an indexing mechanism to automatically rotate the upper rail lift rod 216 and the upper rail lift spools 212, 214, winding up the upper rail lift cords 218, 220 onto the spools 212, 214 without requiring a motor. Then, when the user releases the upper rail 204, the lock will hold the upper rail 204 in position. Similarly, if the user begins with the shade 200 in the position shown in FIG. 42, when the user releases the lock in the upper movable rail 204 and pushes downwardly on the upper rail 204, the upper rail lift cords 218, 220 will pull on the upper rail lift spools 212, 214, causing those spools to unwind, which, in turn, will cause the lower rail lift cords 238, 240 to wind up onto the counterwrap spools 224, 226.

Of course, either or both of the upper and lower rails 204, 206 could have both a motor and a releasable lock functionally connected to their respective lift rods 216, 236.

Figure 44:
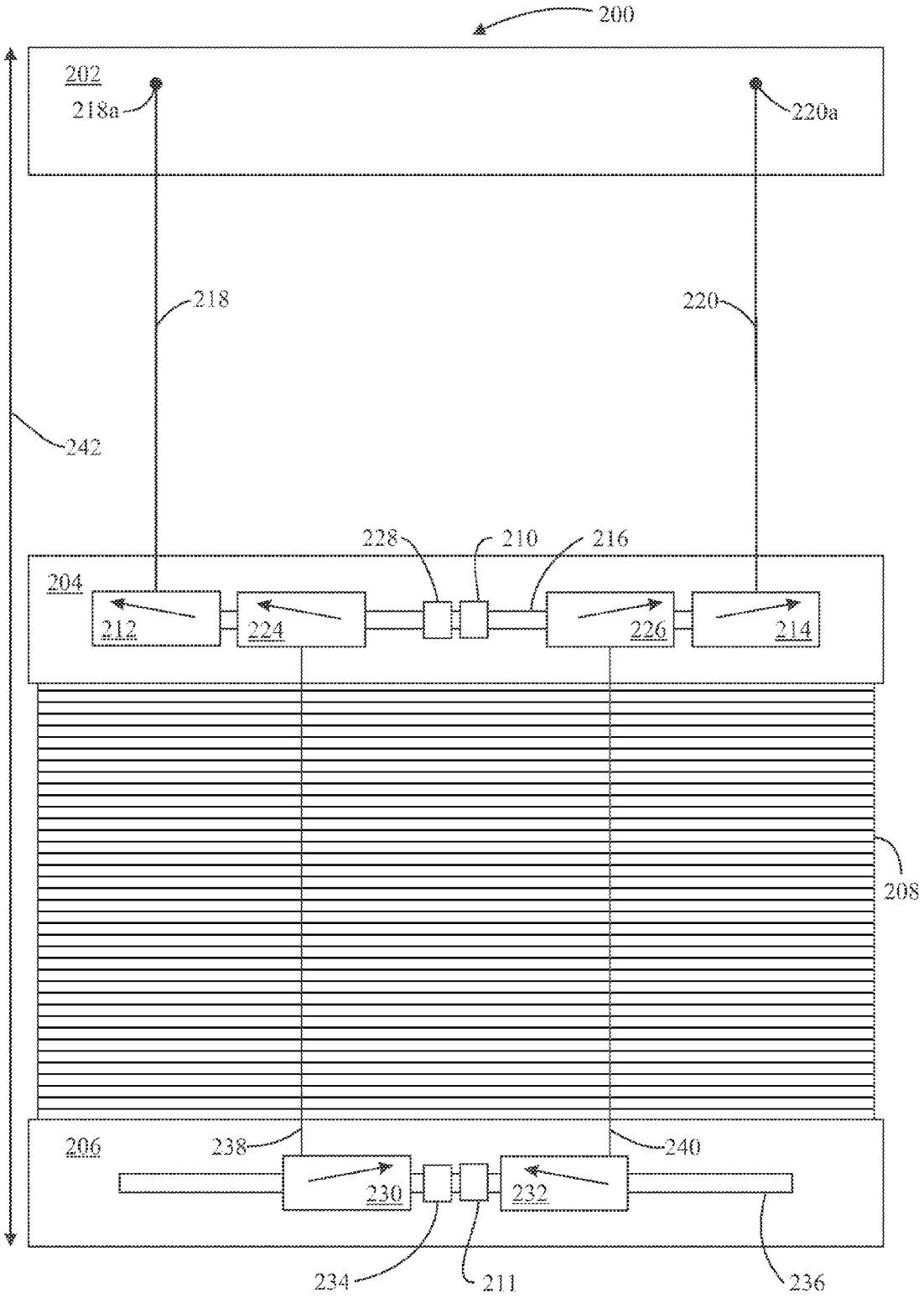
FIG. 44 is a schematic of the shade of FIG. 40 but showing a covering extending from the upper movable rail to the lower movable rail and including brakes on both movable rails.

FIG. 44 shows a shade 200* which is similar to the shade 200 of FIGS. 40-43 except that it shows the covering material 208 and has brakes 210, 211 acting on their corresponding lift rods 216, 236. The brakes 210, 211 and their corresponding motors 228, 234 may be a combination spring motor and drag brake, similar to the spring motor and drag brake 24* of FIG. 20 to selectively stop the rotation of their corresponding lift rods 216, 236. A brake could be used on one or more of the lift rods, as needed, depending upon the forces involved.

It will be obvious to those skilled in the art that additional movable rails may be added, with each movable rail being suspended from the next adjacent movable rail above it, and with each pair of adjacent movable rails having its corresponding automatic variable stroke limiter to ensure that the overall length of the resulting shade does not exceed a desired length, which is usually the length of the opening to which it is mounted.

It should also be noted that the lift mechanisms in either of the movable rails may alternatively make use of other known mechanisms that provide for the cord spools to rotate together. For instance, U.S. Pat. No. 7,117,919 "Judkins" shows interconnected spools and spring motors. U.S. Pat. No. 7,093,644 "Strand" shows gear driven spools.

It also will be obvious to those skilled in the art that additional modifications may be made to the embodiments described above without departing from the scope of the invention as claimed.

What is claimed is:

1. A covering for an architectural opening, comprising:

a first horizontal movable rail having a left end and a right end;

an extendable covering material connected to said first horizontal movable rail, wherein movement of said first horizontal movable rail upwardly and downwardly extends and retracts the extendable covering material;

a second horizontal movable rail below said first horizontal movable rail;

first and second lift spools positioned on said second horizontal movable rail for rotation together;

a first lift cord extending from a first fixed point above said first horizontal movable rail to said first lift spool;

a second lift cord extending from a second fixed point above said first horizontal movable rail to said second lift spool;

an elongated rod positioned on said first horizontal movable rail and extending in a left-to-right direction; and first and second windlass spools coupled to said elongated rod for rotation therewith, said first lift cord wrapping around said first windlass spool and said second lift cord wrapping around said second windlass spool;

wherein;

said second horizontal movable rail is suspended on said first and second lift cords and rotation of said first and second lift spools causes said first and second lift cords to wrap onto and off of said first and second lift spools to raise and lower said second horizontal movable rail; and wherein said first horizontal movable rail is suspended on said first and second lift cords and rides up and down on said first and second lift cords to raise and lower said first horizontal movable rail independently of said second horizontal movable rail.

2. A covering for an architectural opening as recited in claim 1, and further comprising:

at least one of a brake or a lock positioned on said first horizontal movable rail that stops the rotation of said elongated rod in at least one direction to stop the first horizontal movable rail from falling.

3. A covering for an architectural opening as recited in claim 2, wherein said at least one of said brake or said lock stops the rotation of said elongated rod in both directions, and further comprising an actuator providing user control of said at least one of said brake or said lock.

4. A covering for an architectural opening as recited in claim 1, further comprising:

first and second windlass housings positioned on said first horizontal movable rail for housing said first and second windlass spools, respectively; and wherein each of said first and second windlass housings defines a cord entry port and a cord outlet port to allow said first lift cord to pass through said first windlass housing and second lift cord to pass through said second windlass housing.

5. A covering for an architectural opening as recited in claim 4, further comprising:

a first biasing member extending within said first windlass housing, said first biasing member configured to press said first lift cord against said first windlass spool; and a second biasing member extending within said second windlass housing, said second biasing member configured to press second lift cord against said second windless spool.

6. A covering for an architectural opening as recited in claim 4, wherein:

each of said first and second windlass housings defines at least one circumferential guiding groove:

said first lift cord being received within said at least one circumferential guide groove of said first windlass housing as said first lift cord wraps around said first windlass spool; and said second lift cord being received within said at least one circumferential guide groove of said second windlass housing as said second lift cord wraps around said second windlass spool.

7. A covering for an architectural opening as recited in claim 1, wherein:

each of said first and second windlass spools defines opposed frustoconical surfaces tapering inwardly towards a common axial location;

said first lift cord is wrapped around said first windlass spool between said opposed frustoconical surfaces of said first windlass spool; and said second lift cord is wrapped around said second windlass spool between said opposed frustoconical surfaces of said second windlass spool.

8. A covering for an architectural opening as recited in claim 7, wherein each of said first and second windlass spools further comprises circumferentially spaced ribs extending between said opposed frustoconical surfaces across said common axial location.

9. A covering for an architectural opening, comprising:

a first horizontal movable rail;

an extendable covering material connected to said first horizontal movable rail, wherein movement of said first horizontal movable rail upwardly and downwardly extends and retracts the extendable covering material;

an elongated rod positioned on said first horizontal movable rail and extending in a left-to-right direction;

first and second windlass spools coupled to said elongated rod for rotation therewith;

a first taut cable extending downwardly from a first fixed point above said first horizontal movable rail, wrapping around said first windlass spool, and extending downwardly below said first windlass spool; and a second taut cable extending downwardly from a second fixed point above the said first horizontal movable rail, wrapping around said second windlass spool, and extending downwardly below said second windlass spool.

10. A covering for an architectural opening as recited in claim 9, and further comprising:

at least one of a brake or a lock positioned on said first horizontal movable rail that stops the rotation of said elongated rod in at least one direction to stop the first horizontal movable rail from falling.

11. A covering for an architectural opening as recited in claim 10, and further comprising an actuator for use by an operator to actuate said at least one of said brake or said lock.

12. A covering for an architectural opening as recited in claim 9, and further comprising:

a second horizontal movable rail below said first horizontal movable rail;

first and second lift spools positioned on said second horizontal movable rail for rotation together;

said first taut cable extending downwardly from said first windlass spool to said first lift spool; and said second taut cable extending downwardly from said second windlass spool to said second lift spool;

wherein:

said second horizontal movable rail is suspended on said first and second taut cables and rotation of said first and second lift spools causes said first and second taut cables to wrap onto and off of said first and second lift spools to raise and lower said second horizontal movable rail; and said first horizontal movable rail is suspended on said first and second taut cables and rides up and down on said first and second taut cables to raise and lower said first horizontal movable rail independently of said second horizontal movable rail.

13. A covering for an architectural opening as recited in claim 9, further comprising:

first and second windlass housings positioned on said first horizontal movable rail for housing said first and second windlass spools, respectively; and wherein each of said first and second windlass housings defines a cord entry port and a cord outlet port to allow said first taut cable to pass through said first windlass housing and second taut cable to pass through said second windlass housing.

14. A covering for an architectural opening as recited in claim 13, further comprising:

a first biasing member extending within said first windlass housing, said first biasing member configured to press said first taut cable against said first windlass spool; and a second biasing member extending within said second windlass housing, said second biasing member configured to press second taut cable against said second windless spool.

15. A covering for an architectural opening as recited in claim 13, wherein:

each of said first and second windlass housings define at least one circumferential guiding groove:

said first taut cable being received within said at least one circumferential guide groove of said first windlass housing as said first taut cable wraps around said first windlass spool; and said second taut cable being received within said at least one circumferential guide groove of said second windlass housing as said second taut cable wraps around said second windlass spool.

16. A covering for an architectural opening as recited in claim 9, wherein:

each of said first and second windlass spools defines opposed frustoconical surfaces tapering inwardly towards a common axial location;

said first taut cable is wrapped around said first windlass spool between said opposed frustoconical surfaces of said first windlass spool; and said second taut cable is wrapped around said second windlass spool between said opposed frustoconical surfaces of said second windlass spool.

17. A covering for an architectural opening as recited in claim 16, wherein each of said first and second windlass spools further comprises circumferentially spaced ribs extending between said opposed frustoconical surfaces across said common axial location.

* * * * *